US011549766B2

(12) United States Patent
Abma et al.

(10) Patent No.: US 11,549,766 B2
(45) Date of Patent: Jan. 10, 2023

(54) SYSTEMS AND METHODS OF USING CLEANING ROBOTS FOR REMOVING DEPOSITS FROM HEAT EXCHANGE SURFACES OF BOILERS AND HEAT EXCHANGERS

(71) Applicant: Sidel Global Environmental LLC, Atascadero, CA (US)

(72) Inventors: Sidney Abma, Atascadero, CA (US); Parthosarothy K. Mukherji, Pune (IN)

(73) Assignee: Sidel Global Environmental LLC, Atascadero, CA (US)

( * ) Notice: Subject to any disclaimer, the term of this patent is extended or adjusted under 35 U.S.C. 154(b) by 669 days.

(21) Appl. No.: 16/582,181

(22) Filed: Sep. 25, 2019

(65) Prior Publication Data

US 2020/0096265 A1 Mar. 26, 2020

Related U.S. Application Data

(60) Provisional application No. 62/736,546, filed on Sep. 26, 2018.

(51) Int. Cl.

| | |
|---|---|
| ***F28G 1/00*** | (2006.01) |
| ***F28G 1/08*** | (2006.01) |
| ***B08B 9/023*** | (2006.01) |

(52) U.S. Cl.

CPC ..... *F28G 1/08* (2013.01); *B08B 9/023* (2013.01)

(58) Field of Classification Search

CPC ... B08B 7/02; B08B 9/02; B08B 9/023; F22B 37/48; F23J 3/00; F28G 1/08; F28G 3/14

USPC ..... 15/93.1

See application file for complete search history.

(56) References Cited

U.S. PATENT DOCUMENTS

| | | | |
|---|---|---|---|
| 3,800,358 | A | 4/1974 | Ryan |
| 4,538,552 | A | 9/1985 | Smuda |
| 4,813,384 | A | 3/1989 | Zalewski |
| 5,377,381 | A | 1/1995 | Wilson |
| 5,528,789 | A | 6/1996 | Rostamo |
| 5,799,622 | A | 9/1998 | Waldner |
| 7,204,208 | B2 | 4/2007 | Johnson et al. |
| 8,176,883 | B2 | 5/2012 | Brown et al. |
| 8,490,294 | B2 | 7/2013 | Grunert |

(Continued)

FOREIGN PATENT DOCUMENTS

| | | |
|---|---|---|
| CA | 2525730 | 4/2007 |
| CN | 102489481 | 6/2012 |

(Continued)

*Primary Examiner* — Katina N. Henson

(74) *Attorney, Agent, or Firm* — Doherty IP Law Group LLC

(57) ABSTRACT

A system for cleaning heat exchange tubes includes one or more cleaning robots that are assembled with the tubes. Each cleaning robot includes a housing having an opening extending therethrough for receiving one of the heat exchange tubes, a scraper blade extending into the opening of the housing, the scraper blade having an inner scraping edge that opposes the outer surface of one of the tubes, a wheel coupled with the housing for rolling over the outer surface of the tube, and a motor for driving rotation of the wheel to move the cleaning robot over the outer surface of the tube. The system includes a system controller with one or more microprocessors and one or more software programs for monitoring and controlling operation of the cleaning robots.

18 Claims, 22 Drawing Sheets

(56) References Cited

U.S. PATENT DOCUMENTS

| | | | | |
|---|---|---|---|---|
| 9,927,231 | B2 | 3/2018 | Carlier | |
| 2004/0006841 | A1 | 1/2004 | Jameel et al. | |
| 2009/0065031 | A1 | 3/2009 | Macneil et al. | |
| 2009/0101179 | A1 | 4/2009 | Salamanca | |
| 2011/0138550 | A1 | 6/2011 | Park | |
| 2011/0180022 | A1 | 7/2011 | Hawkins et al. | |
| 2017/0023319 | A1 * | 1/2017 | Krewulak | F28G 15/02 |

FOREIGN PATENT DOCUMENTS

| | | | | |
|---|---|---|---|---|
| CN | 107289230 | | | 10/2017 |
| DE | 2113419 | A | * | 9/1973 |
| DE | 2113419 | A1 | * | 9/1973 |
| DE | 202005019405 | | | 2/2006 |
| EP | 2505915 | | | 3/2012 |
| GB | 2258029 | | | 1/1993 |
| JP | 2004251476 | A | * | 9/2004 |
| KR | 101372276 | | | 3/2014 |

* cited by examiner

FIG. 9A
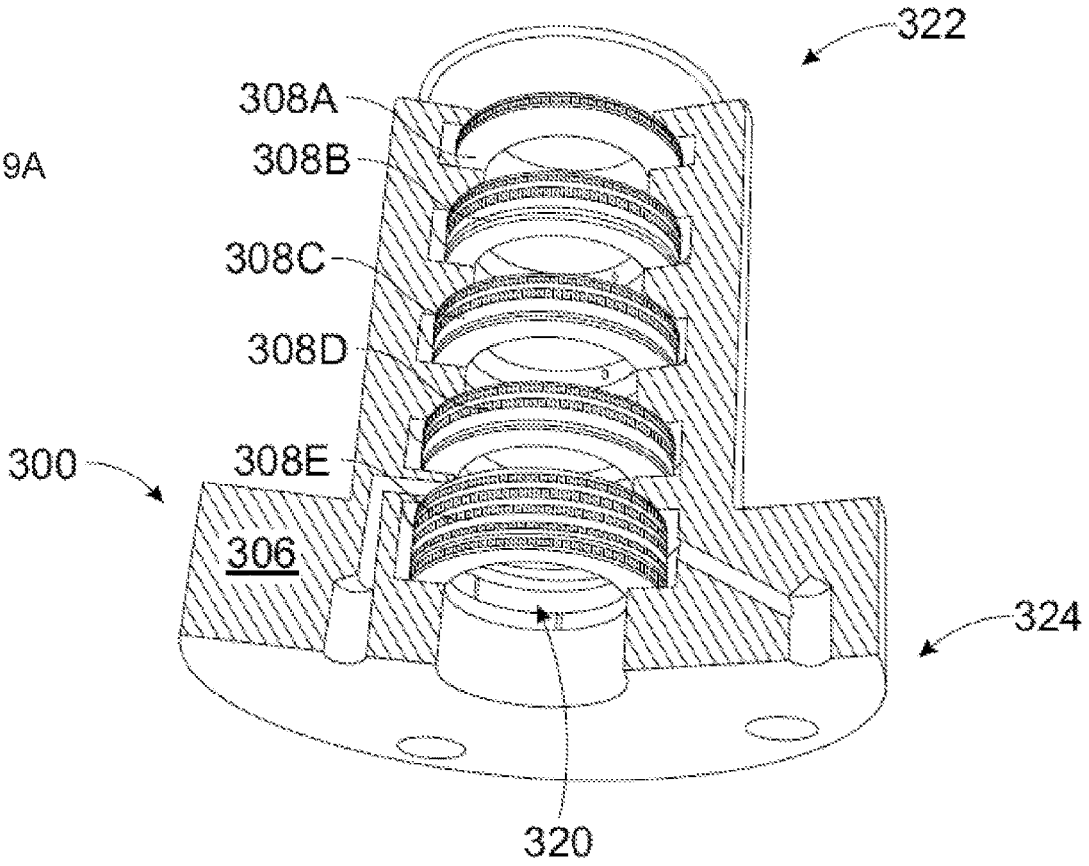
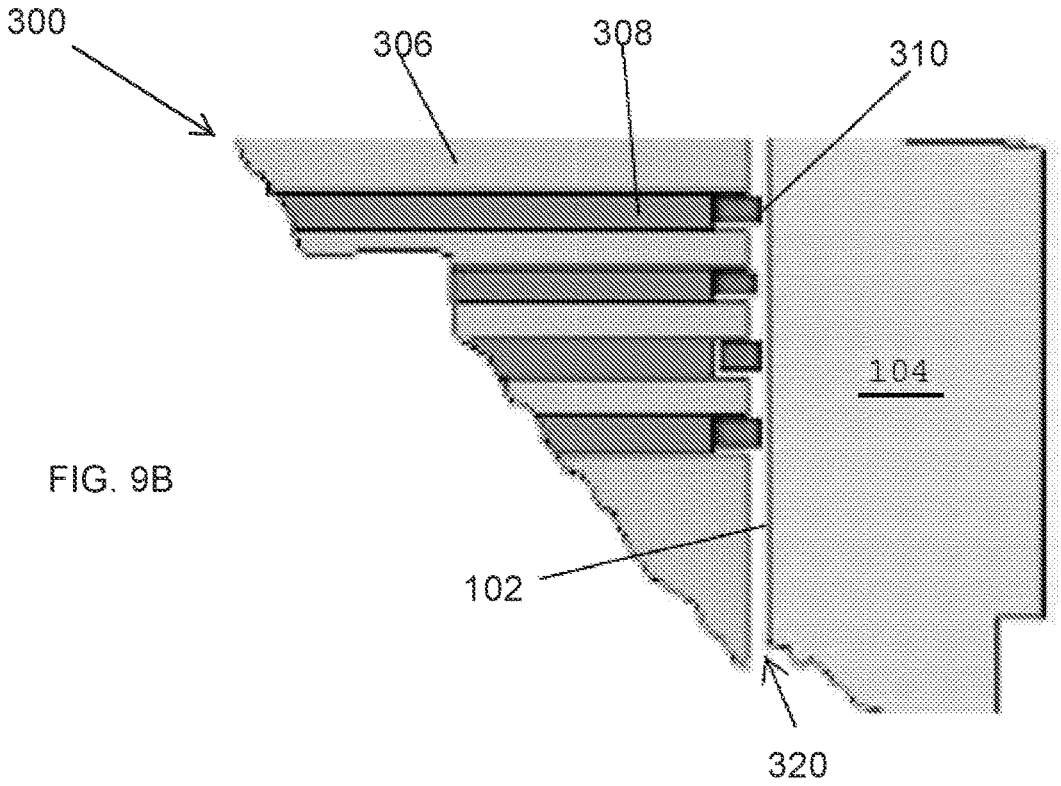
FIG. 9B

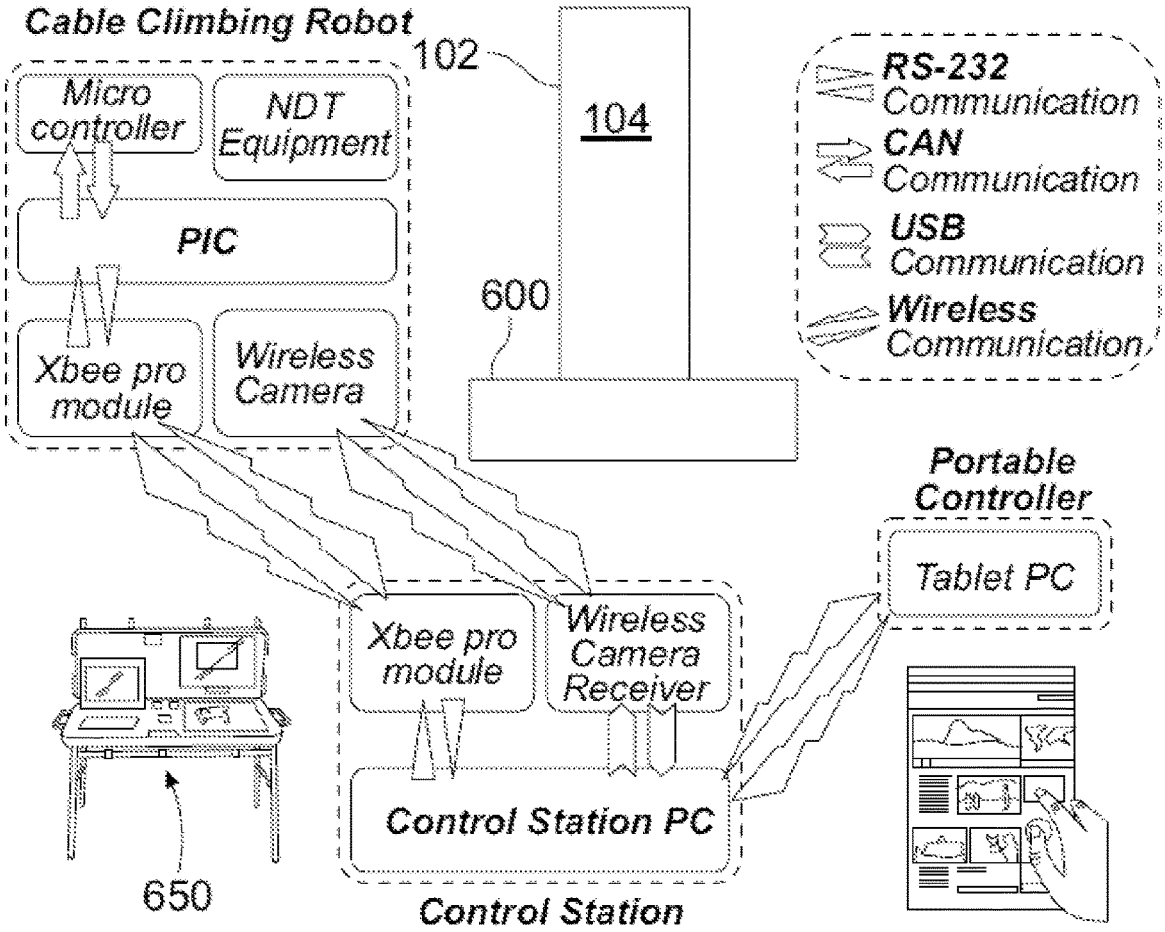
FIG. 14
FIG. 15A
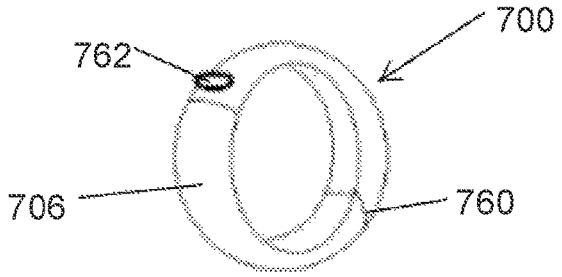
FIG. 15B
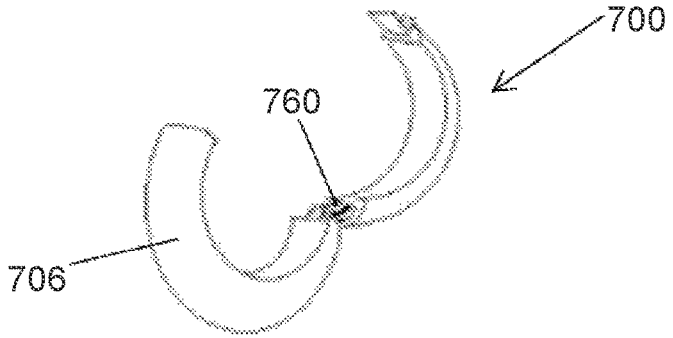

SYSTEMS AND METHODS OF USING CLEANING ROBOTS FOR REMOVING DEPOSITS FROM HEAT EXCHANGE SURFACES OF BOILERS AND HEAT EXCHANGERS

CROSS-REFERENCE TO RELATED APPLICATIONS

The present patent application claims benefit of commonly assigned U.S. Provisional Application No. 62/736,546, filed Sep. 26, 2018, the disclosure of which is hereby incorporated by reference herein.

BACKGROUND OF THE INVENTION

Field of the Invention

The present patent application is generally related to boilers, such as industrial coal fired boilers, and heat exchangers, and is more specifically related to systems and methods for removing deposits such as soot and scale from the heat exchange surfaces of boilers and heat exchangers.

Description of the Related Art

Many industrial processes generate high temperature fluids and exhaust streams in coal fired appliances. Boilers and heat exchangers are designed to create and recover the heat from the high temperature exhaust streams and fluids and utilize the heat. Design variables that may be considered include the type of exhaust.

Boilers are designed to transfer thermal energy from a first combustion stream to a second fluid stream via a thermally conductive heat exchange surface that separates the first and second streams. Heat exchange surfaces need to be free of particulate buildup to allow for full heat transfer capability.

Exhaust streams of combusted fossil fuel and bio fuels contain impurities such as soot and scale. As the exhaust streams pass over the boiler heat exchange surfaces, the surfaces become coated with the components present in the exhaust stream such as soot and scale. The build-up of soot and scale deposits on the heat exchange surfaces will reduce the heat transfer capabilities and efficiency of the heat exchange surfaces. In response, there have been many efforts directed to cleaning soot and scale deposits from heat exchange surfaces including blowing hot steam onto the dirty surfaces to clean the surfaces and remove the soot and scale. Conventional systems and methods for removing soot and scale from heat exchange surfaces have numerous limitations including: 1) requiring the production of steam and energy to be used for cleaning the heat exchange surfaces; 2) not effectively cleaning the surfaces to optimum levels; 3) not treating or reaching all of the surfaces that need cleaning; 4) the high costs and expenses associated with cleaning surfaces; 5) the difficulties associated with maintaining heat exchange surfaces at optimal levels of cleanliness; and 6) the likelihood that the heat exchange surfaces will be damaged when being cleaned.

One significant problem with cleaning heat exchange surfaces is that it requires a lot of energy that must be cannibalized from elsewhere. For example, with an overall thermal efficiency of 34%, a steam generator efficiency of 75 to 85%, and an electrical generator efficiency of 98.5%, a conventional coal-fired power plant uses superheated steam at a rate of 3.47 to 3.93 tons/hour per MW of power output. Thus, a 1000 MW power plant uses 3,470 to 3,930 metric tons of steam per hour and the steam used by the 1,170,000 MW of worldwide power generation by coal-fired and nuclear power plants might be as much as 4,000,000 to 4,600,000 metric tons of steam per hour. Since soot blowers typically consume about 5-12% of the high pressure steam produced by a power plant, conventional systems and methods for removing soot and scale from heat exchange surfaces are expensive.

Referring to FIG. 1, a prior art industrial furnace includes a heat exchange system 50 having matrices of heat exchange tubes 52. The heat exchange system 50 includes an upstream, exhaust gas inlet 54 and a downstream, exhaust gas outlet 56. The heat exchange system 50 also includes an air inlet 58 and an air outlet 60. As the exhaust gas passes through the heat exchange system 50, the heat present in the exhaust gas is transferred to the heat exchange tubes.

FIG. 2 shows a plurality of heat exchange tubes 62. The heat exchange tubes are spaced from one another for allowing the exhaust gas to flow through the tubes 62 as the exhaust gas flows from the exhaust gas inlet 54 to the exhaust gas outlet 56 (FIG. 1). As the hot exhaust gas passes through the heat exchange tubes 62, soot and scale present in the exhaust gas are deposited on the outer surfaces of the walls of the heat exchange tubes 62. As confirmed by thermodynamic analysis, the heat transfer capabilities of the tubes are reduced as soot and scale layers build up on the outer surfaces of the tubes, which require the furnace to work much harder to provide a required heat level. Moreover, the buildup of soot and scale causes undo wear on motors, blowers, and controls, which results in higher operating costs and increased fuel consumption. In order to improve efficiency, heat exchange tubes are frequently cleaned in order to improve heat transfer capabilities, lower operating costs, and save money on fuel. Regardless of the type of fuel that is burned, the heat exchange tubes must be cleaned on a regular basis, which often requires a furnace or boiler to be completely shut down prior to the cleaning operation.

FIG. 3 shows a matrix of the heat exchange tubes 52 shown in FIG. 1. The outer surfaces of the elongated tubes have deposits of soot and scale. Various methods have been employed over the years for cleaning the outer surfaces of the tubes. Traditionally, heat exchange tubes have been cleaned manually by using a brush mounted on a long rod and manually pushing the brush through the tubes, which is a dirty, labor intensive job. In some instances, the tubes are washed with a high pressure hose (e.g., dispensing high pressure water or cleaning solution), which creates a huge mess.

FIG. 4 shows a high pressure water hose being utilized to blast the soot and scale from the outer surfaces of the heat exchange tubes for removing the soot and scale deposits, thereby cleaning the tubes and improving operating efficiencies. Unfortunately, the furnace or boiler must be shut down when cleaning heat exchange tubes with high pressure water or cleaning solution because a human cannot withstand the high temperature environment present in an operating furnace or boiler. The down-time required for cleaning costs a lot of money.

Attempts to replace conventional soot blowing systems and methods with alternative methodologies such as sonic and acoustic blasting of the heat exchange surfaces have also been unsatisfactory. Thus, in spite of the limitations noted above, the above-identified alternative methods have not replaced conventional soot blowing systems and methods for removing soot and scale from heat exchange surfaces.

There remains a need for systems, methods, and devices that provide an optimal cleanliness of all heat exchange surfaces. There also remains a need for systems, methods, and devices that prevent efficiency loss, that do not require parasitic energy consumption, that do not damage heat exchange surfaces, and that are economically viable. There also remains a need for systems and methods that allow heat transfer surfaces to be cleaned as furnaces, reactors and boilers remain in operation.

SUMMARY OF THE INVENTION

Fossil fuel power plants have a major problem with efficiency and carbon emissions. They are not energy efficient and their carbon $CO_2$ emissions are too high. For example, coal enters the power plant and is combusted inside the boilers. There is a lot of heat created when this coal is combusted and also a lot of soot. The heat from the combusted coal travels around all the tubes in the boiler turning water into steam.

Soot blowing is a method used for removing soot from the boiler tubes. The boiler tubes are often made of steel and steam is often used on the boiler tubes during soot blowing operations. Directing steam onto the steel boiler tubes will cause corrosion, which means the affected boiler tubes will have to be replaced. More maintenance and frequent boiler tube replacement equals reduced profit for the utility.

In one embodiment, a new boiler soot cleaning system uses cleaning robots (e.g., the Sidel Soot Bot™) located inside the boilers, which require no steam, that will not harm the boiler tubes during cleaning, and that can be directed to clean the boiler tubes as often as needed. In one embodiment, cables raise and lower the individual cleaning robots so that they can clean the boiler tubes from one end to the other. When the cleaning robots reach the ends of the respective boiler tubes, they may be parked at docking stations where they are protected from the intense heat that is present within the boiler.

The cleaning robot systems and cleaning robots disclosed herein bestow a long awaited development that provides for an efficient and reliable mechanical fossil fuel boiler tube cleaning system. The cleaning robot systems and cleaning robots disclosed herein help to prevent maintenance problems before they occur, which will provide increased revenue to coal and other fossil fuel fired power plants.

The systems and methods disclosed herein will help utilities that combust fossil fuels to increase their operating energy efficiency and subsequently their profit margins.

In one embodiment, a cleaning robot system preferably includes built-in optical lenses and/or cameras that transmit images of each tube surface back to a video monitoring screen so that operators can see the condition of the tubes and decide when they need to be cleaned, or if maintenance has to be scheduled.

In one embodiment, using the cleaning robot systems and cleaning robots disclosed herein instead of conventional soot blowers will save power plants huge amounts of money. Clean boiler tubes are more efficient in transferring heat. A 500 megawatt power plant can increase its profit margin by over $40,000 a day through a combination of more efficient heat transfer, savings on boiler tube maintenance, and utilizing the steam generated by the power plant to generate electricity instead of being required to use the steam to clean boiler tubes.

In one embodiment, a cleaning system preferably includes one or more cleaning robot that have rubbing, sliding and/or scraping tools for cleaning deposits such as soot and scale from boilers, heat exchange surfaces of boilers, heat exchangers, and/or surfaces of heat exchangers.

In one embodiment, the cleaning robots are able to clean heat transfer surfaces while the furnaces, boilers and reactors remain in operation so that it is not necessary or less necessary to shut down energy generating units for cleaning.

In one embodiment, a system for cleaning a surface of a boiler tube or a surface of a heat exchanger preferably includes a tube having a first end, a second end, and an outer surface that extends between the first and second ends.

In one embodiment, a cleaning robot is configured to travel over the outer surface of the tube for cleaning the outer surface of the tube.

In one embodiment, a cleaning robot may include a housing having an opening extending through the housing, a cleaning tool mounted on the housing and extending into the opening of the housing, a wheel coupled with the housing, and a motor coupled with the wheel for driving rotation of the wheel to move the housing over the outer surface of the heat exchange tube.

In one embodiment, the system preferably includes a system controller with one or more microprocessors and one or more software programs for monitoring and controlling operation of the cleaning robot.

In one embodiment, the opening in the housing has a cylindrical shape,

In one embodiment, the cleaning tool desirably includes at least one scraper that extends into the cylindrical-shaped opening. In one embodiment, the at least one scraper preferably includes at least one ring-shaped scraper having an inner scraping edge that projects into the cylindrical-shaped opening of the housing and that opposes the outer surface of the heat exchange tube.

In one embodiment, the at least one ring-shaped scraper may include a plurality of ring-shaped scrapers having respective inner scraping edges that extend into the cylindrical-shaped opening of the housing.

In one embodiment, the heat exchange tube passes through the cylindrical-shaped opening of the housing.

In one embodiment, the inner scraping edge of the at least one ring-shaped scraper opposes the outer surface of the heat exchange tube for removing waste deposits from the outer surface of the heat exchange tube without negatively impacting the outer surface of the tube (e.g., scratching or marring the outer surface of the tube).

In one embodiment, the housing may be made of a ceramic material to protect the components of the cleaning robot from elevated temperatures found within boilers, furnaces, and reactors.

In one embodiment, the motor preferably is an electric motor that is coupled with the wheel. The system may include a battery that produces electricity for the electric motor. The battery may be rechargeable. The battery may be a lithium battery.

In one embodiment, a system may include a charging station for re-charging the battery.

In one embodiment, the system controller is preferably in wireless communication with the cleaning robot.

In one embodiment, the cleaning robot may include a GPS device for recording location and velocity information for the cleaning robot. In one embodiment, the location and velocity information may be wirelessly transmitted to the system controller.

In one embodiment, a system for cleaning heat exchangers preferably includes a boiler having two or more heat exchange tubes (e.g., 200 heat exchange tubes) that are spaced from one another for allowing combusted exhaust to pass between the heat exchange tubes.

In one embodiment, cleaning robots are assembled with the spaced heat exchange tubes. In one embodiment, each one of the cleaning robots is assembled with a different one of the heat exchange tubes.

In one embodiment, each cleaning robot preferably includes a housing having an opening extending therethrough for receiving one of the heat exchange tubes, a scraper blade extending into the opening of the housing, the scraper blade having an inner scraping edge that opposes an outer surface of one of the heat exchange tubes, a wheel coupled with the housing for rolling over the outer surface of one of the heat exchange tubes, and a motor coupled with the wheel for driving rotation of the wheel to move the cleaning robot over the outer surface of one of the heat exchange tubes.

In one embodiment, the system desirably includes a system controller having one or more microprocessors and one or more software programs for monitoring and controlling operation of each of the cleaning robots.

In one embodiment, the system controller is preferably in wireless communication with each of the cleaning robots. In one embodiment, the cleaning robots move independently of one another. In one embodiment, the cleaning robots move together over the respective heat exchange tubes.

In one embodiment, the opening in the housing has a cylindrical shape. In one embodiment, the scraper blade includes a ring-shaped scraper blade that projects into the cylindrical-shaped opening of the housing.

In one embodiment, the outer surface of the heat exchange tube defines an outer diameter, and the inner scraping edge of the ring-shaped scraper blade defines an inner diameter that is greater than the outer diameter of the outer surface of the heat exchange tube.

In one embodiment, each heat exchange tube has a first end, a second end, and a length that extends between the first and second ends.

In one embodiment, the one or more software programs include code for controlling the location of each cleaning robot along the length of a heat exchange tube.

In one embodiment, the one or more software programs include code for controlling the direction of movement of each cleaning robot along the length of a heat exchange tube.

In one embodiment, the one or more software programs include code for controlling the velocity of each cleaning robot as it moves along the length of a heat exchange tubes.

In one embodiment, the one or more software programs may include code for activating the motors for moving the cleaning robots back and forth between the first and second ends of the respective heat exchange tubes. In one embodiment, as the cleaning robots move over the heat exchange tubes, the scraper blades are configured to remove deposits from the outer surfaces of the heat exchange tubes.

In one embodiment, a system for cleaning a heat exchanger preferably includes a first heat exchange tube having an outer surface and a second heat exchange tube having an outer surface, whereby the first and second heat exchange tubes are spaced from one another to enable exhaust to pass therebetween.

In one embodiment, the system may include a first cleaning robot assembled with the first heat exchange tube and being configured to travel over the outer surface of the first heat exchange tube to clean deposits from the outer surface of the first heat exchange tube, and a second cleaning robot assembled with the second heat exchange tube and being configured to travel over the outer surface of the second heat exchange tube to clean deposits from the outer surface of the second heat exchange tube. A typical large coal fired boiler may need 300 of more cleaning robots to keep all of the boiler tubes operating in as new condition.

In one embodiment, a system for cleaning heat exchangers preferably includes a system controller including one or more microprocessors and one or more software programs for monitoring and controlling operation of each of the first and second cleaning robots. In one embodiment, a system may have hundreds of cleaning robots and the system controller preferably monitors and controls operation of each of the cleaning robots.

In one embodiment, a cleaning robot desirably includes a housing having an opening extending therethrough for receiving one of the heat exchange tubes, a scraper blade extending into the opening of the housing, the scraper blade having an inner scraping edge that opposes the outer surface of the one of the heat exchange tubes, a wheel coupled with the housing and being configured to roll over the outer surface of one of the heat exchange tubes, an electric motor coupled with the wheel for driving rotation of the wheel to move the cleaning robot over the outer surface of one of the heat exchange tubes, and a battery coupled with the electric motor for providing electricity to the electric motor.

In one embodiment, a scraper blade may include a plurality of scraper blades that are spaced from one another and that have respective inner scraping edges that oppose the outer surface of one of the heat exchange tubes.

In one embodiment, the system controller is desirably in wireless communication with the first and second cleaning robots.

In one embodiment, the system may include code for moving cleaning robots, such as the first and second cleaning robots, independently of one another between first and second ends of the respective heat exchange tubes.

In one embodiment, a cleaning system preferably includes one or more cleaning robots that are adapted to operate in high temperature environments found in furnaces and boilers.

In one embodiment, a cleaning system preferably includes one or more cleaning robots that operate independently of one another.

In one embodiment, a cleaning system preferably includes one or more cleaning robots that are in signal sending and receiving relationship with a central controller for coordinating movement of the cleaning robots.

In one embodiment, a cleaning system preferably includes one or more cleaning robots that are adapted to be mobile and move over the outer surfaces of boiler tubes and/or the heat exchange surfaces of heat exchangers.

In one embodiment, a cleaning system preferably includes one or more cleaning robots that are self-actuated.

In one embodiment, a cleaning system preferably includes one or more cleaning robots that are configured to travel along the lengths of tubular heating surfaces in controllable directions and/or at controllable speeds.

In one embodiment, a cleaning system preferably includes one or more cleaning robots that have transport assemblies for controlling movement of the cleaning robots over the heat exchange surfaces.

In one embodiment, a cleaning system preferably includes one or more cleaning robots that have scraping and/or rubbing components that are positioned closely to outer surfaces of heat exchange surfaces for continuously removing deposited material (e.g., soot) from heat exchange surfaces.

In one embodiment, a cleaning system preferably includes one or more cleaning robots that are housed in ceramic protective coverings and or ceramic armor that shields the components of the robots from high temperatures, erosion and corrosion found within furnaces and boilers.

In one embodiment, a cleaning system preferably includes one or more cleaning robots that have built-in rechargeable motors that provide the motive power for the robots when traversing over the heat exchange surfaces.

In one embodiment, a cleaning system preferably includes one or more cleaning robots that have sensors and actuators that are configured to judge the type of actions that are required to be carried, and that also regulate and monitor all parameters related to the performance, locations, and function of the cleaning robots, and that are configured to transmit this information in real time to a central controller and/or a designated server.

In one embodiment, a cleaning robot has a cylindrical shape with an elongated conduit that is adapted to receive a cylindrical-shaped heat exchange tube.

In one embodiment, a cleaning robot has a half cylindrical shape, with a concave surface that is adapted to receive a cylindrical-shaped heat exchange tube.

In one embodiment, a cleaning robot has a rectangular shape or any other special shape that allows it to carry out its functioning in the in situ conditions for which it is deployed.

The typical, standard dimensions of tubular surfaces in heat exchangers for furnaces and boilers are: 1) for a tube having an outer diameter of one inch, the spacing between adjacent tubes is about 0.5 inches; 2) for a tube having an outer diameter of 1.5 inches, the spacing between adjacent tubes is about 0.75 inches; 3) for a tube having an outer diameter of two inches, the spacing between adjacent tubes is about 1.0 inches; 4) for a tube having an outer diameter of three inches, the spacing between adjacent tubes is about 1.5 inches; and 4) for a tube having an outer diameter of four inches, the spacing between adjacent tubes is about 2.0 inches.

In one embodiment, the tubes have outer diameters within a range of about 1-6 inches. In one embodiment, the tubes have outer diameters of about 1-4 inches. The tubes are preferably spaced from one another.

In one embodiment, a cleaning robot may be designed for any tubular or semi-tubular surface over which it is configured to traverse.

In one embodiment, a cleaning robot preferably has a length of about 5-20 inches and more preferably about 9-16 inches. In one embodiment, a cleaning robot has a height of about 1.50-6.50 inches and more preferably about 1.50-4.50 inches. In one embodiment, a cleaning robot has a width of about 1.50-6.0 inches. The above-described dimensions for a cleaning robot are exemplary in nature only and may be modified.

In one embodiment, a cleaning system may include two or more cleaning robots that are adapted to clean the outer heat exchange surfaces of boiler tubes and/or the outer surfaces of tubes found in a heat exchanger. The two or more cleaning robots may simultaneously move together over outer surfaces of heat exchange tubes or may move independently of one another.

In one embodiment, a system may have two or more cleaning robots, whereby the movement of the individual robots may be staggered at intervals so as to minimize any interference to flow of gasses and/or prevent turbulence due to their movement.

In one embodiment, in response to cleaning criteria, each cleaning robot is preferably programmed to traverse over a heat exchange surface at selected speed and/or frequency of traverse. In one embodiment, the rate of deposition of soot and scale and the frequency and speed of traverse of the cleaning robots over the heat exchange surfaces may be automatically linked and/or adjusted as required. For example, if the rate of soot deposition is greater, the cleaning robots may traverse the heat exchange surfaces more frequently and/or rapidly. In one embodiment, as the rate of soot deposition slows down, the cleaning robots may traverse the heat exchange surfaces less frequently and/or at a slower speed.

In one embodiment, the removal of the soot and scale deposits from the tubular surfaces of the heat exchange tubes may be accomplished by a combination of a scraping device, sliding surface-to-surface contact, and/or rotational surface-to-surface contact.

In one embodiment, the scraper elements and/or the sliding elements are preferably configured to the tube dimensions and deposit thickness and do not affect the tubular elements surface, but only scrape/rub away the deposits. In one embodiment, the scrapers have an inner dimension that closely matches the outer dimensions of the tubes without physically contacting the outer surfaces so as to avoid damaging the outer surfaces.

In one embodiment, a cleaning robot may include a battery, such as a rechargeable battery. In one embodiment, the battery may be a lithium rechargeable battery. In one embodiment, the battery may be protected in a special housing to prevent temperature and in situ conditions affecting its performance and/or life. In one embodiment, the battery and the protective housing may be engineered to effectively operate within a nuclear reactor and adhere to nuclear reactor standards.

In one embodiment, a cleaning robot may move over an outer surface of a heat exchange tube like an inch worm. In one embodiment, a first end of a cleaning robot may tether and/or secure itself to an outer surface of a heat exchange tube that is being cleaned, then by using one or more internal cable-type tensioning mechanisms, a second end of the cleaning robot may be pulled toward the first end, which drags one or more scrapping elements at the second end over the outer surface of the heat exchange tube for removing soot and scale from the outer surface. After the two end have been pulled together, the second end of the cleaning robot may tether and/or secure itself to the outer surface of the heat exchange tube, and the first end is inched forward over the outer surface of the heat exchange tube. After inching forward, the first end again tethers and/or secures itself to the outer surface of the heat exchange tubes and then the internal tensioning mechanism pulls the second end toward the first end for repeating the process.

In one embodiment, an outer surface of a heat exchange tube may include one or more indicators (e.g., indicia, a mark, a stripe, code, sensors) for confirming that the cleaning robot has travelled to an end of the heat exchange tube. In one embodiment, the cleaning robot may change directions and travel in an opposite direction after confirming that it has reached an end of a heat exchange tube. In one embodiment, each heat exchange tube may have one or more indicators as described in this paragraph for enabling respective cleaning robots to recognize that they have reached the end of a heat exchange tube. In one embodiment, each cleaning robot may include GPS technology for determining that an end of a heat exchange tube has been reached.

In one embodiment, a system for cleaning a surface of a heat exchanging boiler tube preferably includes a boiler tube having a first end, a second end, and an outer surface that extends between the first and second ends, and a cleaning robot configured to travel over the outer surface of the boiler tube for cleaning the outer surface of the boiler tube. In one embodiment, the cleaning robot desirably includes a housing having an opening extending therethrough, a cleaning tool mounted on the housing and extending into the opening of the housing, a wheel coupled with the housing, and a motor coupled with the wheel for driving rotation of the wheel to move the housing over the outer surface of the boiler tube. In one embodiment, the system desirably includes a system controller having one or more microprocessors and one or more software programs for monitoring and controlling operation of the cleaning robot.

In one embodiment, a system for cleaning heat exchanging boiler tubes desirably includes a boiler having two or more boiler tubes that are spaced from one another for allowing heated exhaust gas to pass between the boiler tubes, whereby each boiler tube has an outer surface. In one embodiment, a plurality of cleaning robots are preferably assembled with the two or more spaced boiler tubes, whereby each one of the cleaning robots is assembled with a different one of the boiler tubes. In one embodiment, each cleaning robot preferably includes a housing having an opening extending therethrough for receiving one of the boiler tubes, a scraper blade extending into the opening of the housing, the scraper blade having an inner scraping edge that opposes the outer surface of the one of the boiler tubes, a wheel coupled with the housing for rolling over the outer surface of the one of the boiler tubes, and a motor coupled with the wheel for driving rotation of the wheel to move the cleaning robot over the outer surface of one of the boiler tubes. In one embodiment, the system desirably has a system controller including one or more microprocessors and one or more software programs for monitoring and controlling operation of each of the cleaning robots.

In one embodiment, a system for cleaning a boiler desirably includes a first boiler tube having an outer surface, and a second boiler tube having an outer surface, whereby the first and second boiler tubes are spaced from one another. In one embodiment, the system may include a first cleaning robot assembled with the first boiler tube and being configured to travel over the outer surface of the first boiler tube to clean deposits from the outer surface of the first boiler tube, and a second cleaning robot assembled with the second boiler tube and being configured to travel over the outer surface of the second boiler tube to clean deposits from the outer surface of the second boiler tube. In one embodiment, the system preferably includes a system controller including one or more microprocessors and one or more software programs for monitoring and controlling operation of each of the first and second cleaning robots.

These and other preferred embodiments of the present invention will be described in more detail below.

BRIEF DESCRIPTION OF THE DRAWINGS

FIG. 9A shows a cross-sectional view of a cleaning robot configured to remove soot and scale from an outer surface of a heat exchange tube, in accordance with one embodiment of the present patent application.

FIG. 9B shows a partial cross-sectional view of the cleaning robot shown in FIG. 9A.

FIG. 14 shows a schematic view of a system including one or more cleaning robots for cleaning outer surfaces of heat exchange tubes of heat exchangers, in accordance with one embodiment of the present patent application.

FIG. 15A shows a perspective view of a cleaning robot having a housing with a hinge for moving the cleaning robot between an open configuration and a closed configuration.

FIG. 15B shows the cleaning robot of FIG. 15A with the housing in an open configuration.

DETAILED DESCRIPTION OF PREFERRED EMBODIMENTS

Figure 1:
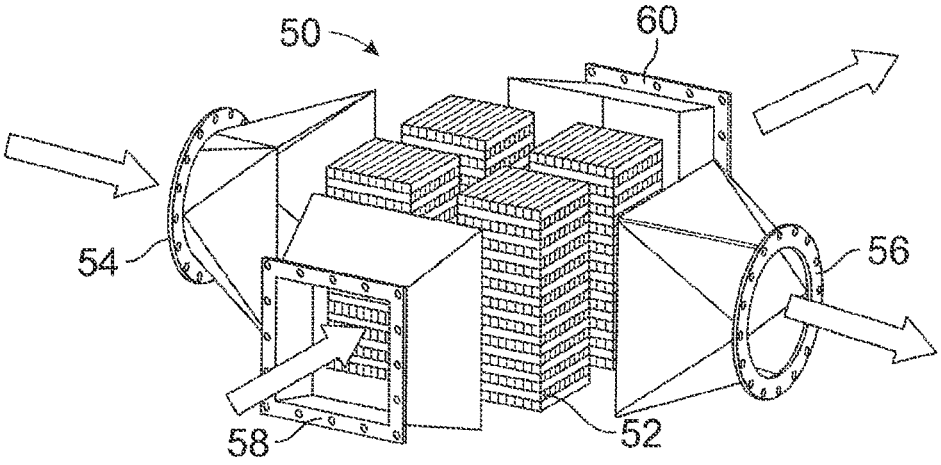
FIG. 1 (PRIOR ART)
FIG. 1 shows a prior art heat exchanger system.
Figure 2:
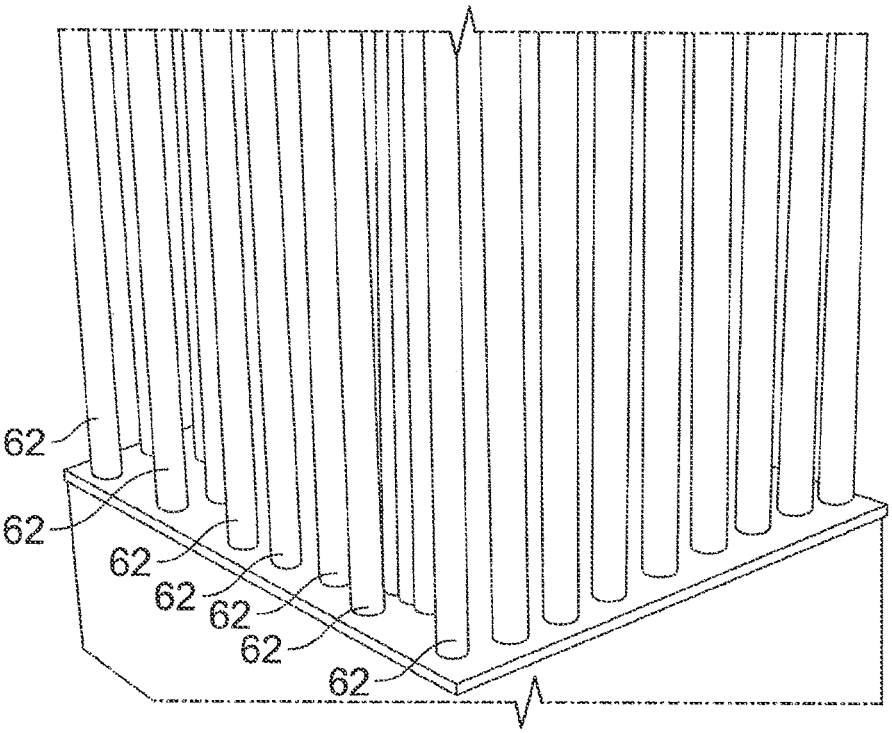
FIG. 2 (PRIOR ART)
FIG. 2 shows a perspective view of a prior art heat exchanger having a plurality of heat exchange tubes that are spaced from one another.
Figure 3:
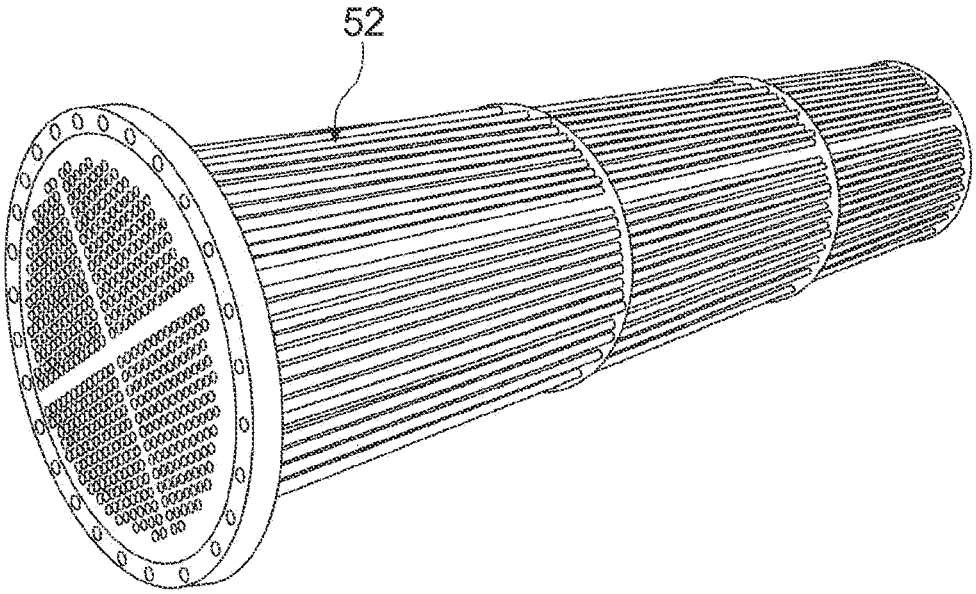
FIG. 3 (PRIOR ART)
FIG. 3 shows a perspective view of a prior art heat exchanger having a plurality of heat exchange tubes with outer surfaces that are covered with soot.
Figure 4:
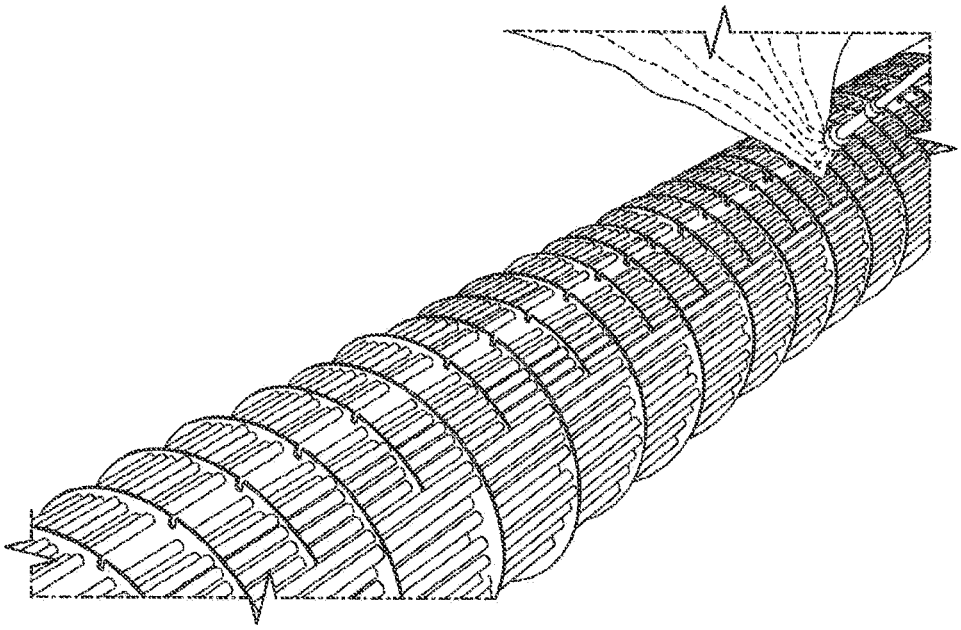
FIG. 4 (PRIOR ART)
FIG. 4 shows a prior art method of cleaning the heat exchange tubes of the heat exchanger shown in FIG. 3.
Figure 5:
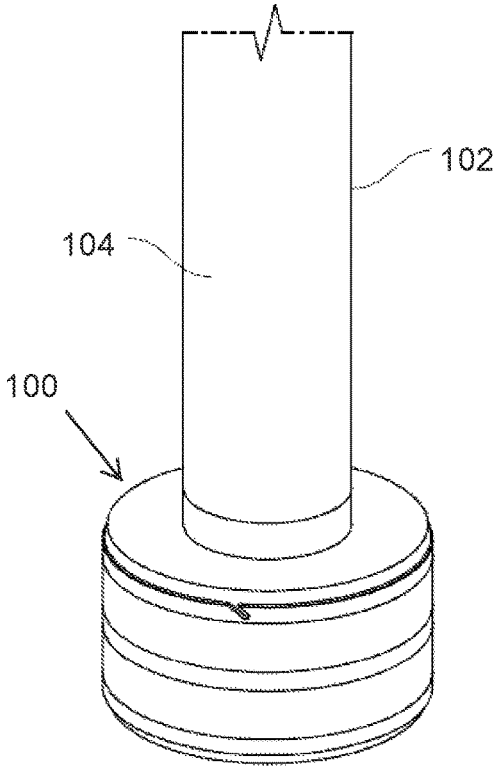
FIG. 5 shows a system including a cleaning robot for cleaning an outer surface of a heat exchange tube, in accordance with one embodiment of the present patent application.

Referring to FIG. 5, in one embodiment, a system for cleaning a heat exchanger preferably includes a cleaning robot 100 that is configured to remove soot and scale deposits that build up on an outer surface 102 of a heat exchange tube 104. In one embodiment, the soot and scale deposits build up on the outer surface 102 as exhaust gases pass over the heat exchange tube 104. In order to improve, the heat transfer efficiency of the heat exchange tube 104, the soot and scale must be periodically removed from the outer surface 102 of the tube.

In one embodiment, the cleaning robot 100 is adapted to move over the outer surface of the heat exchange tube 104 for removing the soot and scale from the tube. The cleaning robot 100 may include one or more scraper blades for scraping the soot and scale from the tube. The cleaning robot may have a transport assembly (e.g., wheels), which may be activated for moving the robot over the length of the tube. The cleaning robot may have wireless communication capabilities for sending information to a central controller and receiving commands from the central controller.

Figure 6A:
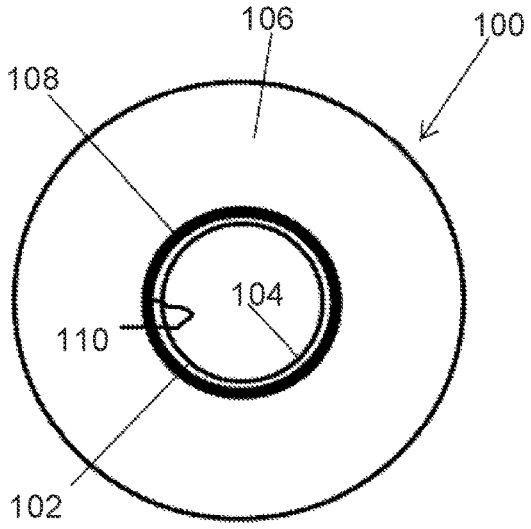
FIG. 6A shows a top plan view of a cleaning robot having a ring-shaped scraper blade, in accordance with one embodiment of the present patent application.
Figure 6B:
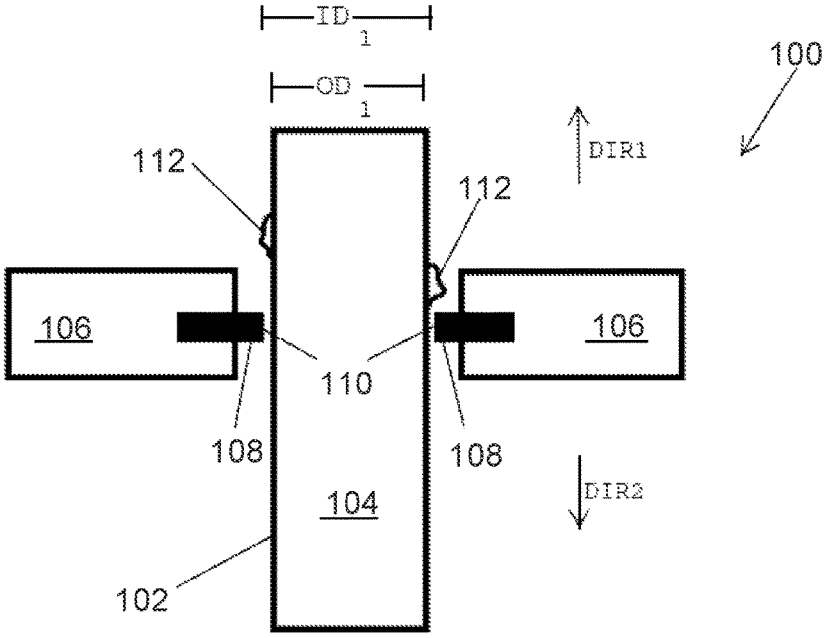
FIG. 6B shows a cross-sectional side view of the cleaning robot and the ring-shaped scraper blade shown in FIG. 6A.

Referring to FIGS. 6A and 6B, in one embodiment, the heat exchange tube 104 preferably has the outer surface 102. The cleaning robot 100 is assembled over the outer surface 102 of the tube 104 and is adapted to slide over the outer surface for removing soot and scale deposits from the tube 104. In one embodiment, the cleaning robot 100 operates in a high temperature environment such as the temperatures present inside furnaces, reactors and boilers. The cleaning robot 100 is preferably made of materials that are able to withstand the high temperatures present inside furnaces, reactors and boilers. In one embodiment, the cleaning robot 100 has a housing 106 that is able to withstand high levels of heat. In one embodiment, the housing 106 may be made of a ceramic material.

In one embodiment, the housing 106 of the cleaning robot 100 has a central opening that receives at least one scraper, such as a ring-shaped scraper 108, which projects inwardly into the central opening from the housing 106. In one embodiment, the ring-shaped scraper 108 has an inner edge 110 that defines an inner diameter $ID_1$ that closely matches but is slightly larger than the outer diameter $OD_1$ defined by the outer surface 102 of the tube 104. In one embodiment, the inner diameter of the scraper 108 is slightly larger than the outer diameter of the outer surface 102 of the tube 104 so that the scraper 108 may slide over the outer surface 102 of the tube to remove soot and scale from the outer surface without scratching and/or marring the outer surface 102 of the tube 104.

FIG. 6B shows scale and soot 112 deposited on the outer surface 102 of the tube 104. It is preferable to remove the soot and scale 112 from the outer surface for improving the heat transfer capabilities of the tube 104. In one embodiment, the cleaning robot 100 moves toward the upper end of the tube 104 in the direction indicated DIR1 so that the inner edges 110 of the ring-shaped scraper 108 may clean the soot 112 from the outer surface 102 of the tube 104. The cleaning robot may move in the direction DIR2 for returning to the lower end of the tube. The cleaning robot may periodically cycle back and forth between the upper and lower ends of the tube for removing soot and scale from the outer surface of the tube for enhancing the thermal conductivity of the tube.

Figure 7A:
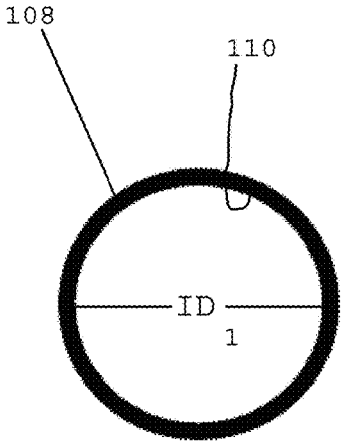
FIG. 7A shows a top plan view of the ring-shaped scraper shown in FIGS. 6A and 6B.

Referring to FIG. 7A, in one embodiment, the ring-shaped scraper 108 desirably has an inner edge 110 that defines an inner diameter $ID_1$ that closely matches but is slight larger than the outer diameter $OD_1$ of the tube 104 (FIG. 6B).

Figure 7B:
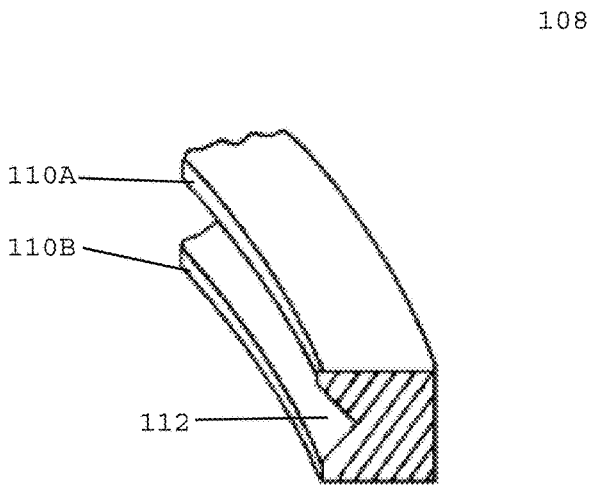
FIG. 7B shows a partial cross-sectional view of the ring-shaped scraper shown in FIG. 7A.

Referring to FIG. 7B, in one embodiment, the ring-shaped scraper 108 has an inner face including a groove 112 formed therein to define a first scraper edge 110A and a second scraper edge 110B, with the groove 112 extending between the first and second scraper edges 110A, 110B.

Figure 8:
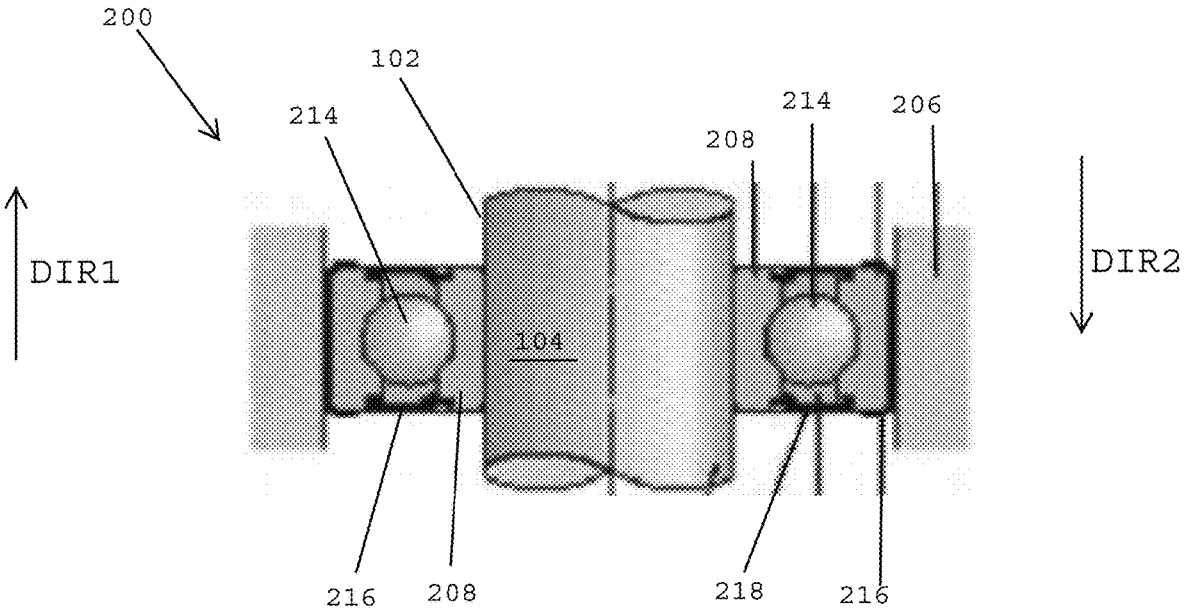
FIG. 8 shows a cross-sectional side view of a cleaning robot configured to clean an outer surface of a heat exchange tube, in accordance with one embodiment of the present patent application.

Referring to FIG. 8, in one embodiment, a cleaning robot 200 preferably includes a ceramic housing 206 that contains a scraper assembly 208 adapted to remove soot from an outer surface 102 of a heat exchange tube 104. In one embodiment, the cleaning robot 200 is configured to slide over the outer surface 102 of the tube 104 for removing soot and scale from the outer surface. In one embodiment, the cleaning robot 200 includes an array of ball bearings 214 that are held in bearing assemblies 216. The ball bearings 214 preferably extend around the outer surface 102 of the tube 104. As the cleaning robot 200 moves in either the direction designated DIR1 or the direction designated DIR2, the scraper assembly 208 removes soot and scale from the outer surface 102 of the tube 104. After the soot and scale has been scraped away from the outer surface 102 of the tube 104, the soot and scale is directed toward the ball bearings 214 for being ground up, and the ground up soot and scale then preferably passes through an opening 218 at the bottom of the bearing assembly 216 for falling to the floor of the furnace, reactor or boiler.

Referring to FIG. 9A, in one embodiment, a cleaning robot 300 preferably includes a housing 306, which may be made of a ceramic material for withstanding high temperature environments, having a central opening 320 extending between an upper end 322 and a lower end 324 of the housing 306. In one embodiment, the central opening 320 is elongated and is adapted to receive a heat exchange tube 104 (FIG. 5). In one embodiment, the cleaning robot 300 desirably includes a plurality of ring-shaped scrapers 308A-308E that may be spaced from one another between the upper and lower ends 322, 324 of the housing 306. The scraper may extend into the central opening 320 of the housing 306. In one embodiment, the ring-shaped scrapers 308A-308E preferably have respective inner diameters that closely match (but are slightly greater than) an outer diameter of a heat exchange tube assembled with the cleaning robot 300.

Referring to FIG. 9B, in one embodiment, the cleaning robot 300 is assembled over an outer surface 102 of a heat exchange tube 104. The cleaning robot 300 includes the ceramic housing 306 with ring-shaped scraper 308 projecting inwardly from the housing 306 and into the central opening 320 for removing soot and scale from the outer surface 102 of the heat exchange tube 104. Each of the scrapers 308 preferably has an inner edge 310 that defines an inner diameter that closely matches the outer diameter defined by the outer surface 102 of the tube 104. In one embodiment, the distance between the inner edges 310 of the respective ring-shaped scrapers 308 and the outer surface 102 of a tube 104 may be modified by adjusting the inner dimension of the scrapers 308. In one embodiment, the inner dimension adjustment of the scrapers 308 may be made using a servomotor, hydraulics, or any other mechanism for making micro-adjustments of the inner edges 310 relative to the outer surface 102 of the heat exchange tube 104.

In one embodiment, the distance between the inner edges of the scrapers and the outer surface of the heat exchange tube may be greater (i.e., position #1) when removing larger particles of soot and scale from the tube (e.g., gross contamination), and smaller (position #2) for removing finer particles of soot and scale from the outer surface of the tube (e.g., micro contamination). The robot may move faster over the tube when in position #1 and slower over the tube when in position #2 to prevent scratching of the outer surface of the tube when the scraping blades are closer to the outer surface.

In one embodiment, the cleaning robot 300 preferably includes a plurality of ring-shaped scrapers, whereby two or more of the scrapers may be adjusted for modifying the distance between the inner edge of a scraper and the outer surface 102 of the tube 104.

Figure 10A:
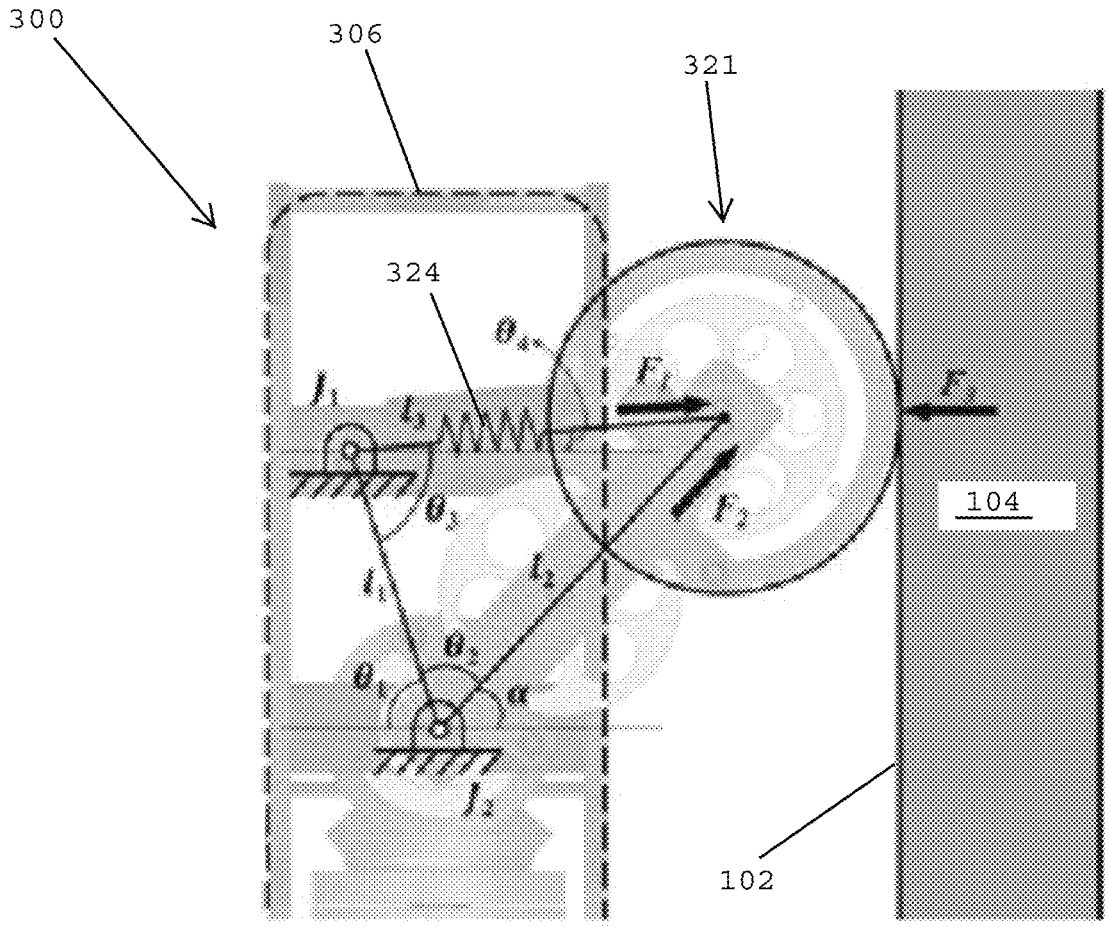
FIG. 10A shows a transport assembly for a cleaning robot, in accordance with one embodiment of the present patent application.

Referring to FIG. 10A, in one embodiment, the cleaning robot 300 preferably includes a transport assembly 321 that desirably transports and/or moves the cleaning robot 300 over the outer surface 102 of the tube 104. In one embodiment, the heat exchange tubes form a vertical array whereby the tubes extend vertically between a ceiling and a floor of a furnace or boiler. The transport assembly 321 preferably enables the housing 306 of the cleaning robot 300 to selectively move up and down over the outer surface 102 of the tube 104. The transport assembly 321 may include one or more rotatable wheels, a gear-train for driving the wheels, a clamping assembly for holding the housing in a stationary position, a motor (e.g., an electric motor), and a power source (e.g., a rechargeable battery). In one embodiment, the heat exchange tubes 104 may extend in a horizontal direction relative to the floor and the ceiling of a furnace, reactor or boiler and the transport assembly 321 enables the housing 306 to move over the outer surface 102 of the heat exchange tube 104. In one embodiment, the transport assembly 320 preferably includes at least one wheel 322 that is adapted to roll over the outer surface 102 of the heat exchange tube 104 so that the housing 306 can slide over the outer surface of the tube 104. In one embodiment, the wheel 322 is spring loaded for enabling the wheel to move away from the outer surface of the tube such as when confronting an obstacle.

Figure 10B:
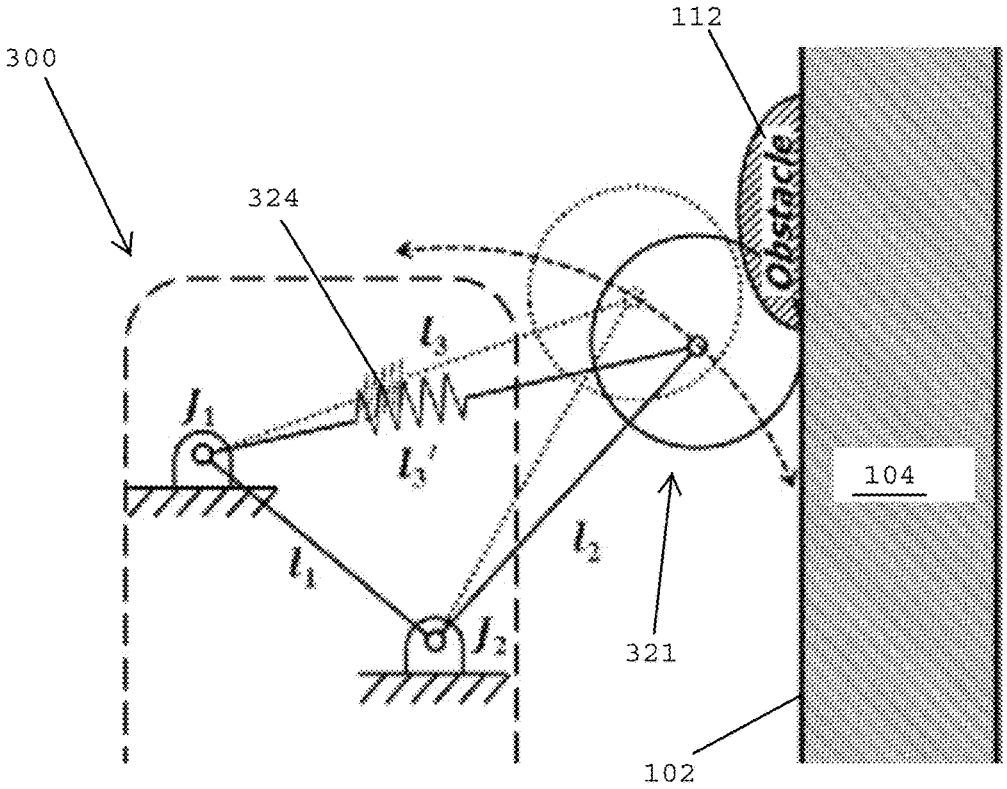
FIG. 10B shows another view of the transport assembly shown in FIG. 10A.

Referring to FIG. 10B, in one embodiment, the cleaning robot 300 may encounter obstacles 112 (e.g., soot and scale buildup) as it moves over the outer surface 102 of the heat exchange tube 104. The spring 324 coupled with the wheel 322 of the transport assembly 320 desirably enables the wheel 322 to move away from the outer surface 102 of the tube 104 for rolling over the obstacle 112. In one embodiment, after the wheel 322 passes the obstacle 112, the spring assembly 324 desirably returns the wheel 322 back into contact with the outer surface 102 of the heat exchange tube 104.

Figure 11:
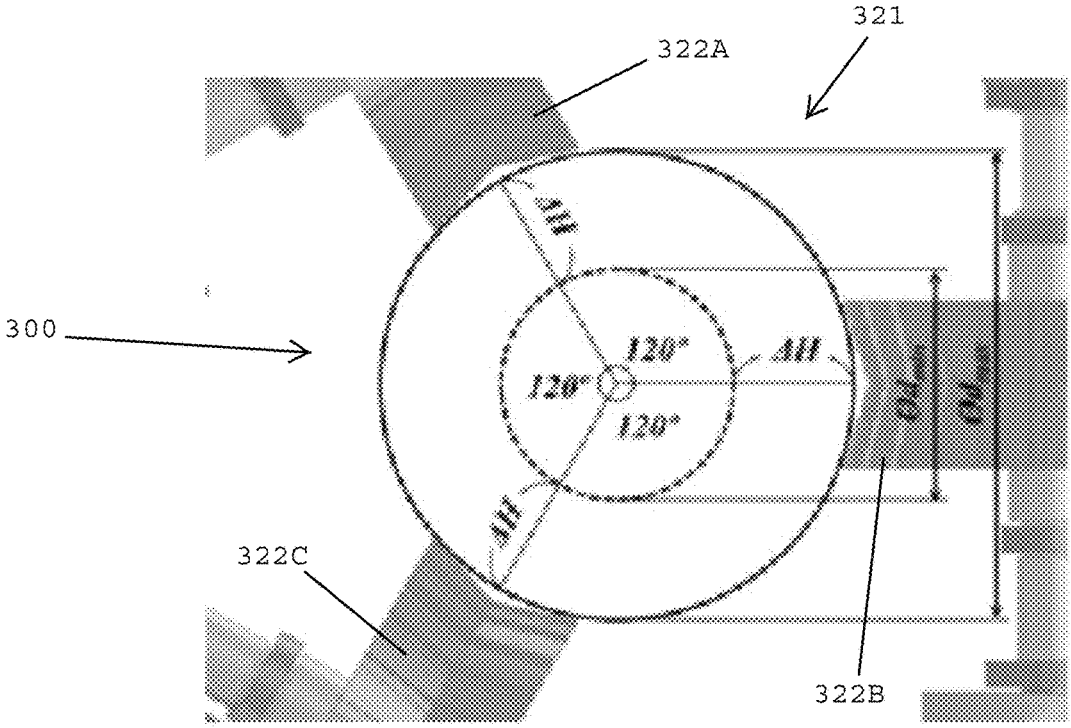
FIG. 11 shows a top plan view of a transport assembly for a cleaning robot configured to clean an outer surface of a heat exchange tube, in accordance with one embodiment of the present patent application.

Referring to FIG. 11, in one embodiment, the transport assembly 321 of a cleaning robot 300 preferably includes two or more wheels that are spaced from one another around the outer surface of the heat exchange tube. In one embodiment, the transport assembly desirably includes three wheels 322A-322C that are evenly spaced from one another around the outer surface 102 of the heat exchange tube 104. In one embodiment, each of the wheels 322A-322C is spaced about 120 degrees away from one another. In one embodiment, one or more of the wheels 322A-322C may be a drive wheel for driving the cleaning robot 300 over the outer surface 102 of the tube 104 and one or more of the wheels 322A-322C may be a passive wheel. The even spacing between the wheels 322A-322C preferably enhances the stability of the cleaning robot 300 as it traverses over the outer surface 102 of the heat exchange tube 104.

Figure 12A:
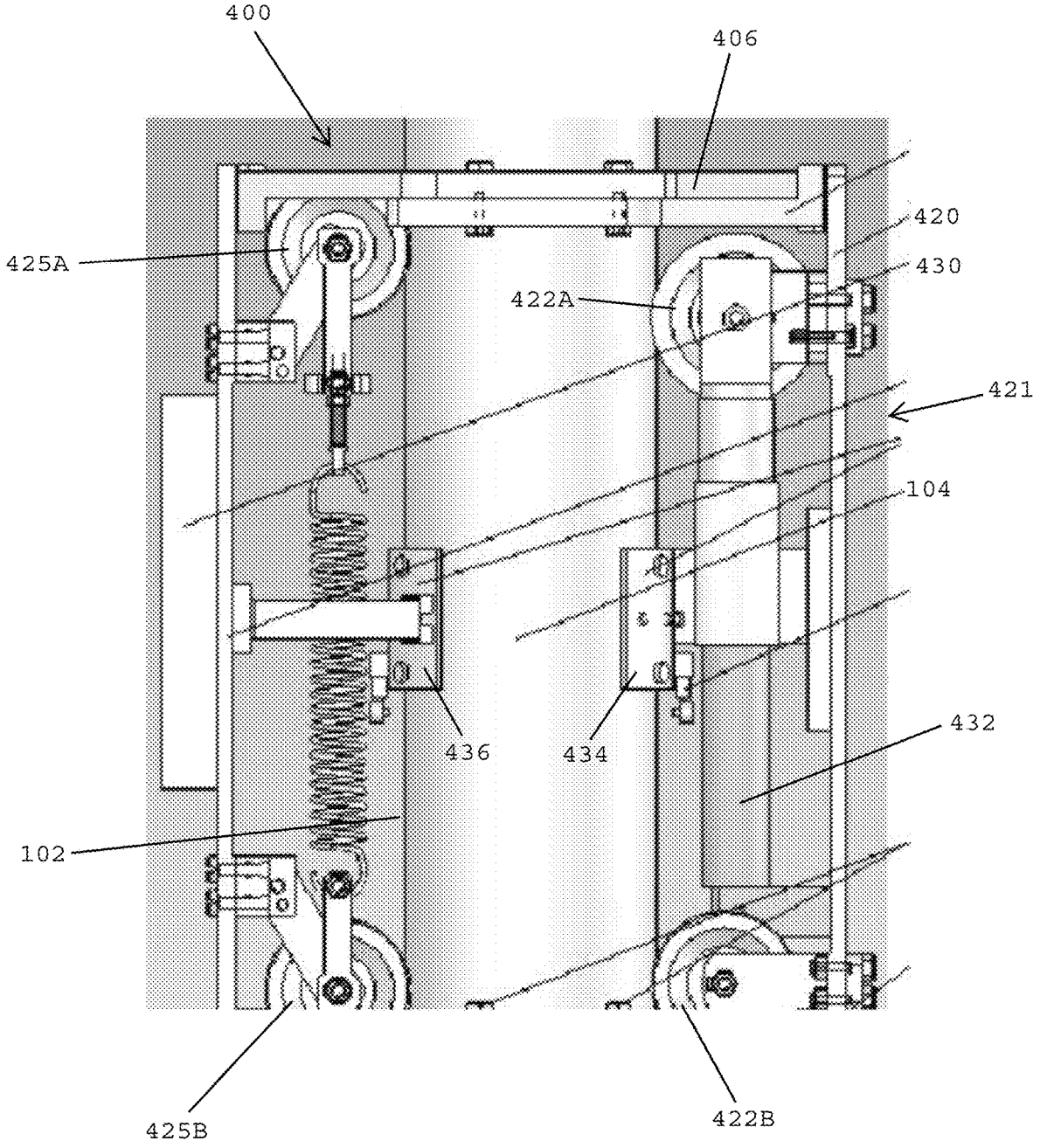
FIG. 12A shows a transport assembly for a cleaning robot used to clean an outer surface of a heat exchange tube, in accordance with one embodiment of the present patent application.

Referring to FIG. 12A, in one embodiment, a cleaning robot 400 is adapted to move over an outer surface 102 of a heat exchange tube 104 (e.g., up and down toward the upper and lower ends of the tube) for removing soot and scale that has built up on the outer surface 102 of the tube. In one embodiment, the cleaning robot 400 preferably includes a heat protective housing, such as a housing made of a ceramic material, which enables the cleaning robot to operate in high temperature environments without damaging the components of the cleaning robot. In one embodiment, the cleaning robot 400 desirably includes a rechargeable battery 430 such as a lithium battery that provides power to the cleaning robot 400 and the wheels 422 of the transport assembly 421.

In one embodiment, the transport assembly 421 preferably includes drive wheels 422A, 422B that are driven by an electric motor 432 and passive wheels 425A, 425B that rotate freely and that are not coupled with the electric motor 432. In one embodiment, the battery 430 provides power to the electric motor 432 for selectively rotating the drive wheels 422A, 422B. The drive wheels 422A, 422B are opposed by the passive wheels 425A, 425B for stabilizing the housing of the cleaning robot 400 as it moves over the length of the tube.

In one embodiment, the cleaning robot 400 desirably includes opposing clamping elements 434, 436 that are adapted to hold the housing 406 in place over the outer surface 102 of the tube 104. In one embodiment, when the drive wheels 422A, 422B are rotating for moving the robot over the length of the tube, the opposing clamps 434, 436 are retracted to enable the cleaning robot 400 to freely move over the outer surface 102 of the tube 104. When the cleaning robot 400 has reached a particular location on the outer surface of the tube, the clamping elements 434, 436 may be extended to clamp onto the outer surface 102 of the tube to hold the cleaning robot 400 in place relative to the outer surface of the tube.

Figure 12B:
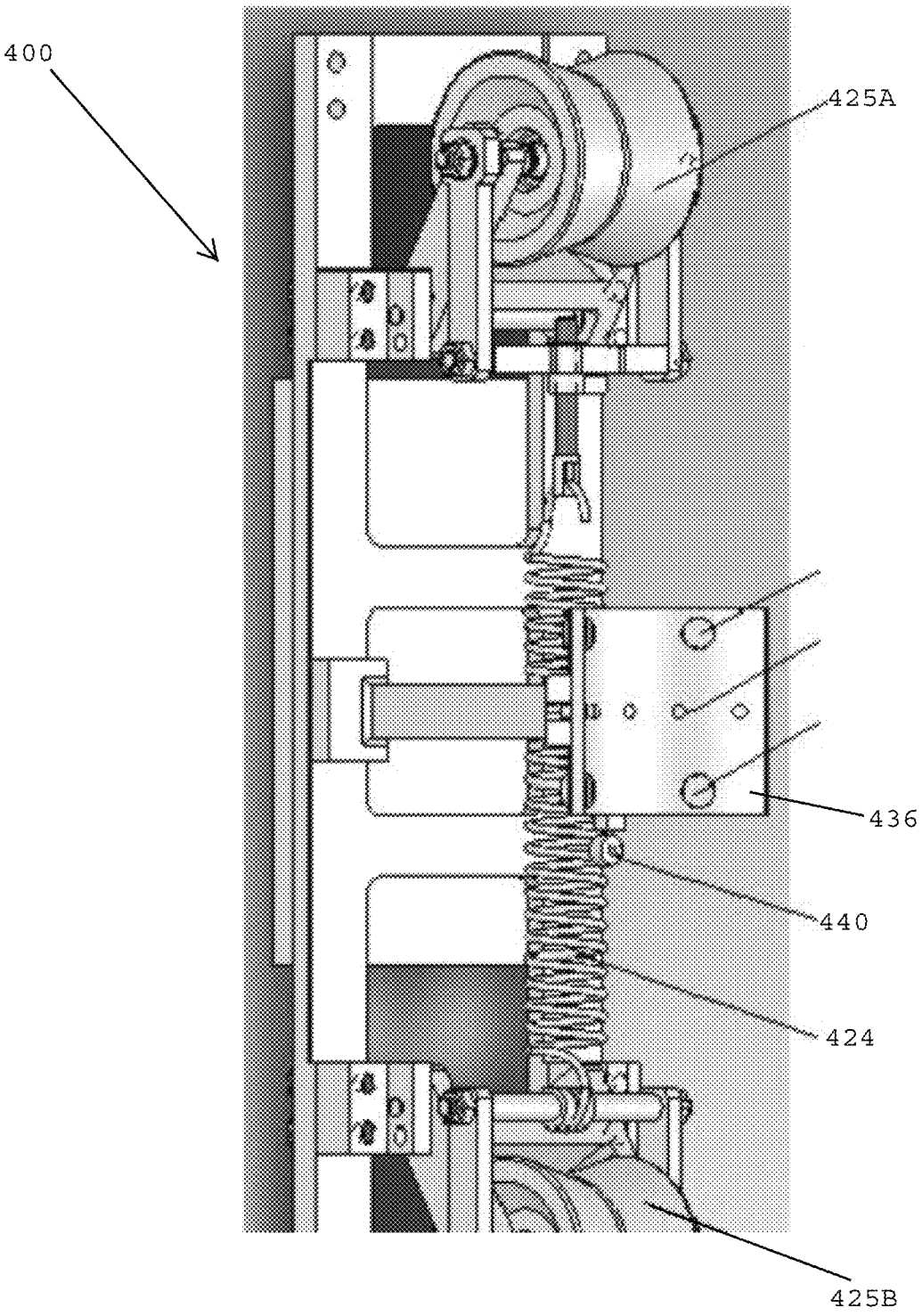
FIG. 12B shows another view of the transport assembly shown in FIG. 12A.

FIG. 12B shows the passive wheels 425A, 425B that oppose the active, drive wheels 422A, 422B shown in FIG. 12A. The passive wheels 425A, 425B are desirably coupled with an extension spring 424 that enables the passive wheels 425A, 425B to retract when confronting obstacles and then extend for re-engaging the outer surface of the tube. In one embodiment, the cleaning robot 400 preferably includes a sensor 440 for detecting obstacles (e.g., soot and scale buildup) that are present on the outer surface of the tube or location indicators provided on the outer surface of the tube. The cleaning robot 400 desirably includes the clamping element 436 that may be extended for holding the cleaning robot 400 in place relative to the outer surface of the tube.

Figure 13:
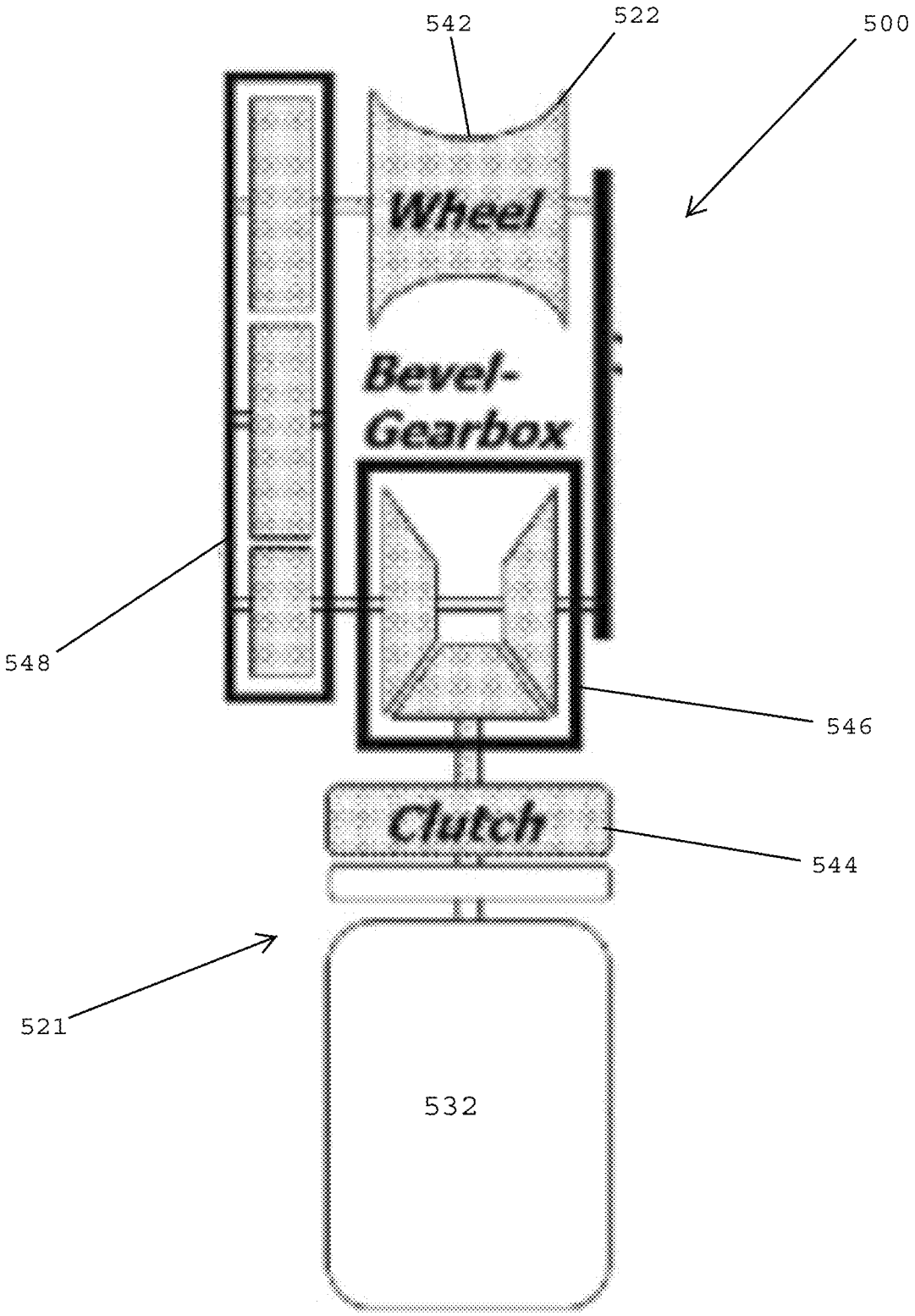
FIG. 13 shows a schematic view of a transport assembly for a cleaning robot used to clean an outer surface of a heat exchange tube, in accordance with one embodiment of the present patent application.

Referring to FIG. 13, in one embodiment, a cleaning robot 500 preferably includes a transport assembly 521 that enables the cleaning robot to selectively move over the outer surface of a heat exchange tube. In one embodiment, the transport assembly 500 desirably includes at least one wheel 522 that is adapted to roll over the outer surface of the heat exchange tube. In one embodiment, the wheel 522 has a concave surface 542 that is configured to match the convex curved, cylindrical outer surface of the heat exchange tube for guiding movement of the cleaning robot 500 over the outer surface of the heat exchange tube.

In one embodiment, the transport assembly 521 of the cleaning robot 500 preferably includes a motor 532, such as an electric motor, that is activated for operating a drive-train. In one embodiment, the drive-train may include a clutch 544, a bevel gear box 546, and a spur gear box 548. In one embodiment, when the motor 532 is activated and the clutch 544 is engaged, the gear-train is driven for rotating the drive wheel 522, which in turn, moves the housing of the cleaning robot 500 over the outer surface of a heat exchange tube.

Referring to FIG. 14, in one embodiment, a system for cleaning heat exchange tubes preferably includes a central controller 650 that is in communication (e.g., wireless communication) with a cleaning robot 600 that is located inside a furnace, reactor or boiler, and that is assembled over an outer surface of a heat exchange tube 104. In one embodiment, the central controller 650 preferably includes one or more microprocessors and one or more software applications for controlling operation of the cleaning robot 600. In one embodiment, the central controller 650 is preferably in wireless communication with electronic devices such as servers, processors, smartphones, tablets, laptop computers, desk-based computers, and electronic components that are capable of interacting with the internet for sending and receiving information to and from the cleaning robot. In one embodiment, the central controller 650 includes one or more programs or applications for controlling the position, direction and speed of the cleaning robot 600 over the outer surface 102 of the tube 104. The central controller 650 is preferably adapted to control the exact location, direction and speed of movement of the cleaning robot over the outer surface of the heat exchange tube 104. In one embodiment, the cleaning robot 600 may have Global Positioning System (GPS) capabilities for communicating the exact location and velocity of the cleaning robot to the central controller 650. As used herein, the term GPS means a radio or wireless navigation system that allows land, sea, and airborne users to determine their exact location, velocity, and time 24 hours a day, in all weather conditions, anywhere in the world. Depending upon the type of cleaning procedure that needs to be performed, the central controller may change the speed of movement and/or the direction of movement of the cleaning robot 600 on the tube 104. The central controller may also change the distance between the inner scraping edges of the scraping blades and the outer surface of the heat exchange tube. For example, the blades may initially be further away from the tube for removing gross contamination from the tube, and then moved closer to the tube for removing micro contamination from the tube. In one embodiment, a cleaning system has two or more cleaning robots that operate independently of one another and the central controller and the wireless electronic devices preferably enable operators to monitor and/or control all of the cleaning robots of a system. The system may be monitored and controlled locally (e.g., while positioned at the site of a furnace) or remotely via electronic devices (e.g., when offsite).

In one embodiment, the control system may be programmed to move the cleaning robots at different speeds over the heat exchange tubes. In one embodiment, a first cleaning robot may move over a first heat exchange tube at a first speed, and a second cleaning robot may move over a second heat exchange tube at a second speed that is different than the first speed.

Referring to FIG. 15, in one embodiment, a cleaning robot 700 may include a housing 706 having a hinge 760 that enables the housing 706 to be moved between an open configuration and a closed configuration. In one embodiment, the housing 706 may include a locking mechanism 762 for locking the housing 706 in the closed position shown in FIG. 15A.

Referring to FIG. 15B, the hinge 760 enables the housing 706 to be moved into an open configuration whereby the cleaning robot 700 may be placed over a heat exchange tube. When the cleaning robot 700 is positioned over the outer surface of the heat exchange tube, the housing may be closed and the locking mechanism 762 engaged for locking the cleaning robot 700 in the closed configuration shown in FIG. 15A. The hinge embodiment preferably enables a cleaning robot to be selectively moved from one heat exchange tube to another heat exchange tube. The hinge embodiment also enables existing heat exchangers to be retrofitted to receive one or more cleaning robots.

Figure 16:
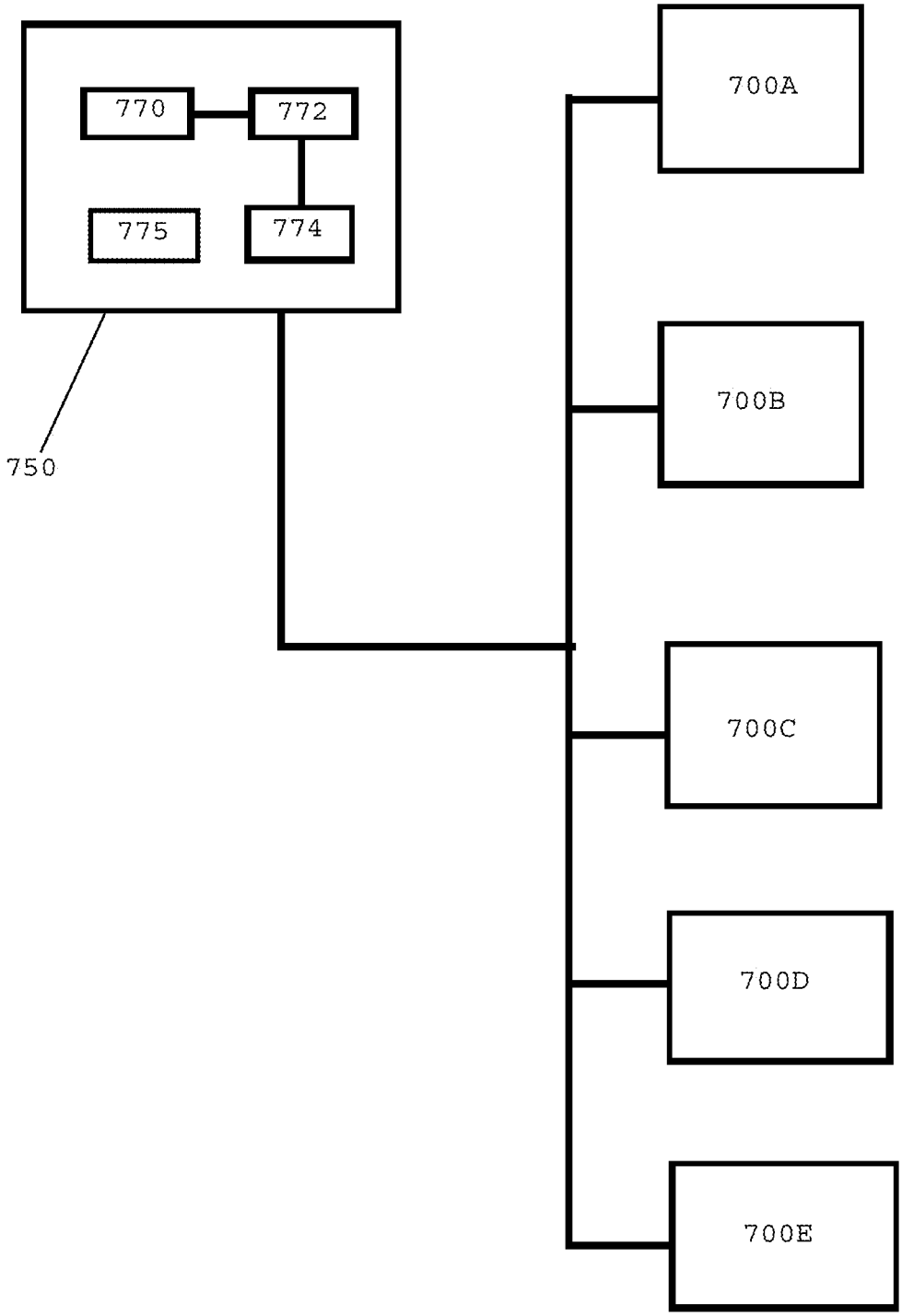
FIG. 16 shows a schematic view of a control system for cleaning robots, in accordance with one embodiment of the present patent application.

Referring to FIG. 16, in one embodiment, a control system 750 for a cleaning system preferably includes one or more microprocessors 770 and one or more software applications stored therein for controlling operation of one or more cleaning robots. In one embodiment, the control system 750 desirably includes a position controller 772 for monitoring and controlling the positions of each of the cleaning robots, a velocity controller 774 for monitoring and/or controlling the velocity of each of the respective cleaning robots, and a direction controller 775 for monitoring and/or controlling the directions of each of the respective cleaning robots. In one embodiment, users may modify selections put into the position controller 772, the velocity controller 774, and the direction controller 775 for changing pre-entered information regarding locations, velocities, and directions for the cleaning robots. In one embodiment, a cleaning system may include a plurality of cleaning robots 700A-700E, whereby each cleaning robot is in signal sending and receiving communication with the central controller 750. In one embodiment, each of the cleaning robots 700A-700E is configured to communicate independently with the central controller 750 so that the respective cleaning robots may be individually controlled by the central controller. The individual control exercised over each cleaning robot may include a unique location for each of the cleaning robots relative to the outer surfaces of the heat exchange tubes associated therewith, a unique velocity for each of the cleaning robots, and a unique direction for each of the cleaning robots. In one embodiment, each of the cleaning robots 700A-700E has wireless communication capabilities, a velocity monitor, a direction monitor, and GPS capabilities for reporting the location, direction and velocity of the cleaning robot to the central controller. The cleaning robots 700A-700E are configured to receive commands from the central controller and to change location, direction and velocity based upon the commands received from the central controller.

In one embodiment, each of the cleaning robots has a rechargeable battery that is utilized for powering an on-board motor such as an electric motor. In one embodiment, the cleaning robots 700A-700E are adapted to connect with one or more charging stations for recharging the batteries. The charging stations are preferably located inside the furnace, reactor or boiler so that the cleaning robots do not have to be removed from their assembly with the heat exchange tubes for recharging the batteries. In one embodiment, the battery of a cleaning robot may be re-charged when the robot reaches an end of a heat exchange tube.

Figure 17:
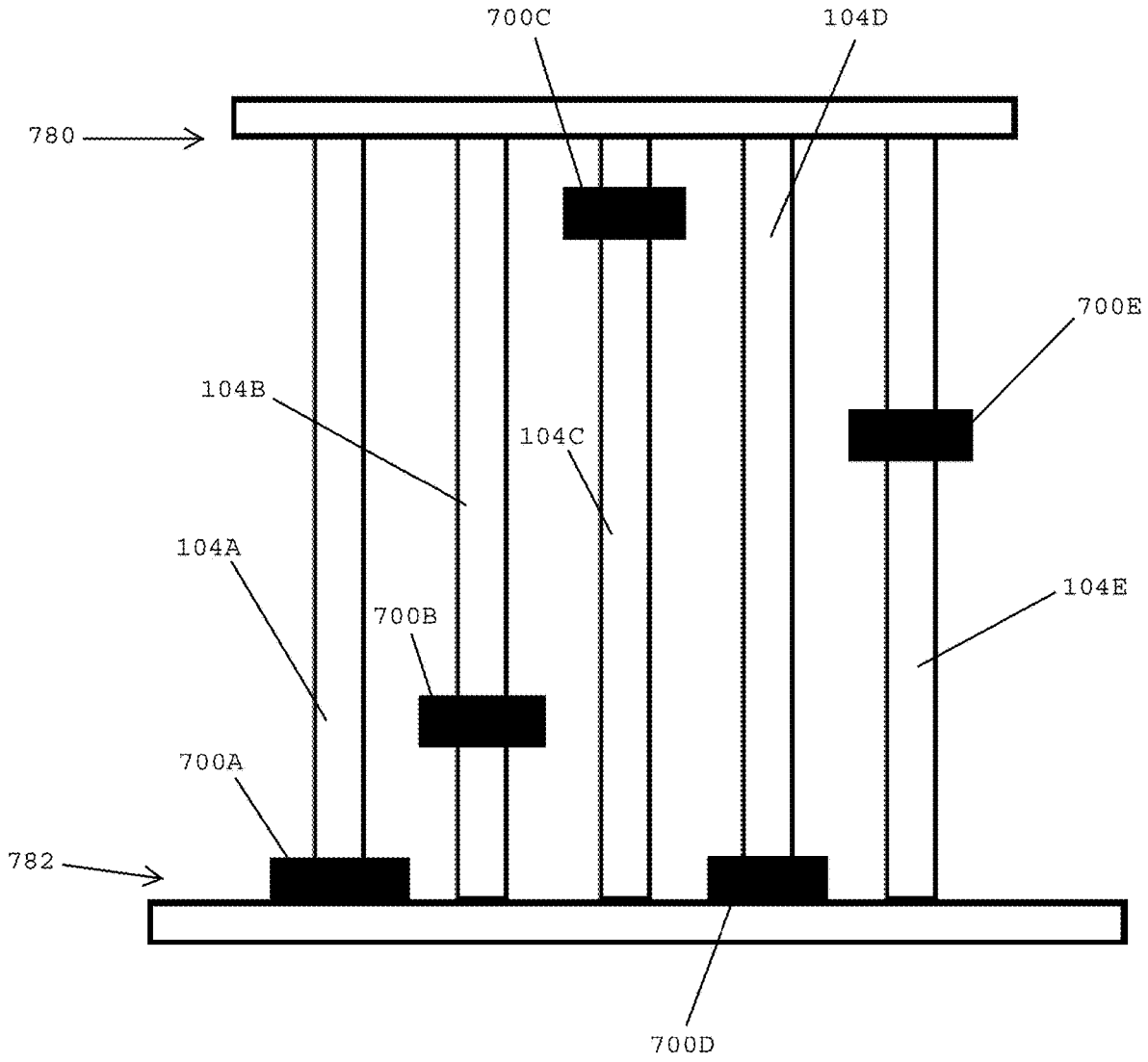
FIG. 17 shows a system for cleaning heat exchange tubes, the system including cleaning robots assembled with respective heat exchange tubes, in accordance with one embodiment of the present patent application.

Referring to FIG. 17, in one embodiment, a cleaning system may include cleaning robots 700A-700E that are assembled over outer surfaces of respective heat exchange tubes 104A-104E of a heat exchange system. The heat exchange tubes are spaced from one another and exhaust or flue gas is passed over the tubes for transferring heat to the heat exchange tubes. The heat exchange tubes 104A-104E have upper ends 780 adjacent a ceiling of the heat exchanger and lower ends 782 adjacent a floor of the heat exchanger. The cleaning robots 700A-700E are adapted to move independently of one another between the upper and lower ends of the respective heat exchange tubes 104A-104E for removing soot and scale from the outer surfaces of the tubes.

In one embodiment, a first cleaning robot 700A may be located at the lower end 782 of a first heat exchange tube 104A. In one embodiment, the first cleaning robot 700A is coupled with a charger for recharging a battery located inside the housing of the first cleaning robot 700A. In one embodiment, cleaning robots 700B-700E are located at different vertical heights along their respective heat exchange tubes 104B-104E as they move over the outer surfaces of the tubes. As the cleaning robots move over the tubes for removing the soot and scale, the system controller may program the cleaning robots for maintaining the robots at different heights relative to one another so as to not to interfere with the flow of exhaust or flue gas through the heat exchanger. For example, in one embodiment, if all of the cleaning robots were located at the same vertical height, the housings of the respective cleaning robots may block the efficient floe of the exhaust or flue gas through the spaces between the heat exchange tubes. Although FIG. 17 shows the cleaning robots at different vertical heights relative to one another, in one embodiment, the system controller may be programmed so that all of the cleaning robots 700A-700E move together simultaneously between the upper and lower ends 780, 782 of the respective heat exchange tubes 104A-104E.

Figure 18A:
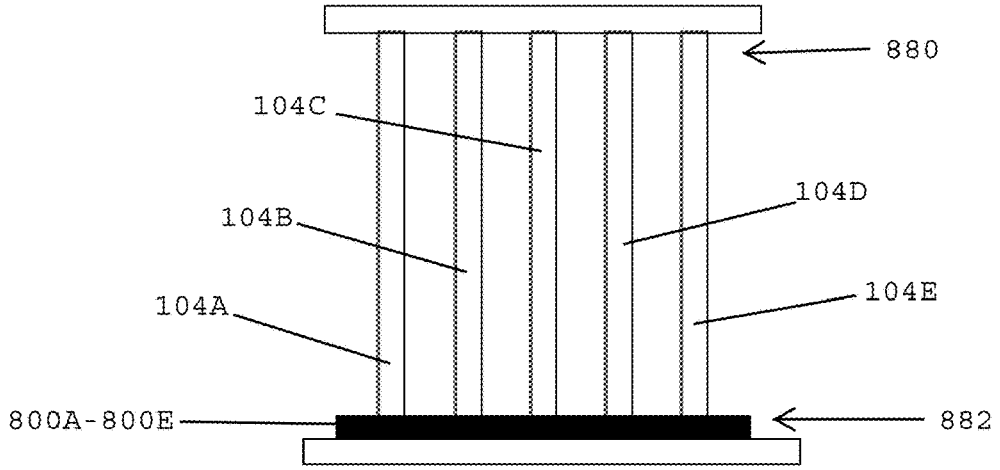
FIG. 18A shows a system for cleaning heat exchange tubes, the system including cleaning robots adapted to move together between upper and lower ends of heat exchange tubes, in accordance with one embodiment of the present patent application.
Figure 18B:
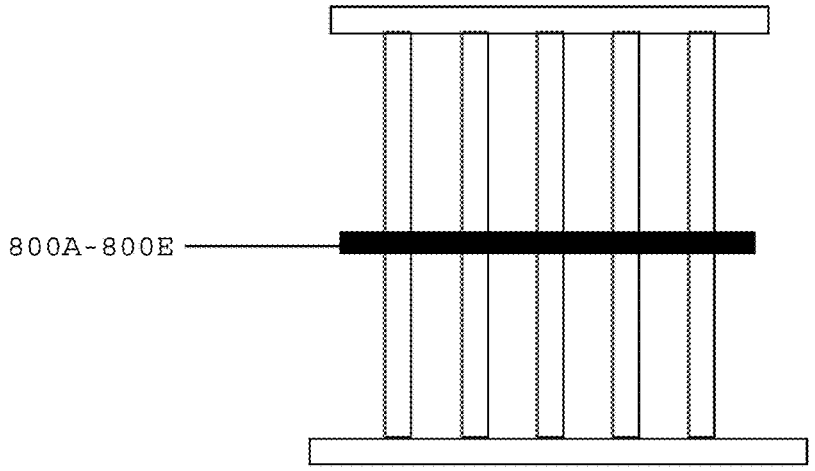
FIG. 18B shows the system of FIG. 18A with the cleaning robots positioned mid-way between the upper and lower ends of the respective heat exchange tubes.
Figure 18C:
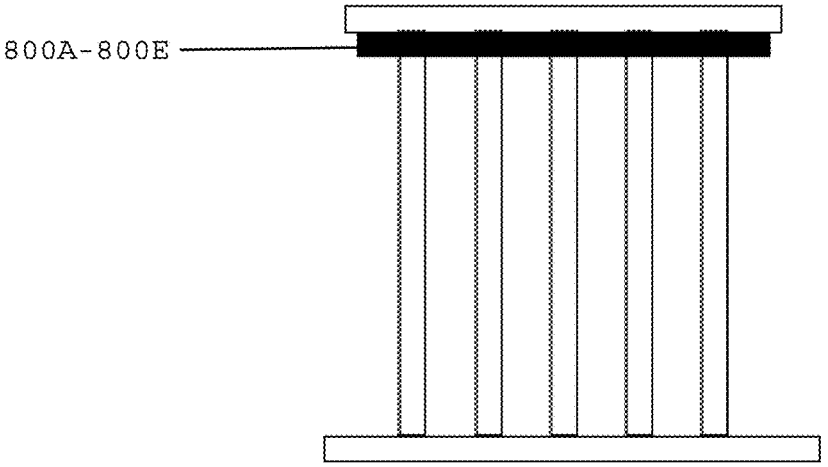
FIG. 18C shows the system of FIGS. 18A and 18B with the cleaning robots positioned at the upper ends of the respective heat exchange tubes.

Referring to FIGS. 18A-18C, in one embodiment, the cleaning robots 800A-800E are adapted to move together simultaneously between the upper ends 880 and the lower ends 882 of the spaced heat exchange tubes 104A-104E. The location, direction, and velocity of the cleaning robots 800A-800B over the outer surfaces of the respective heat exchange tubes 104A-104E is preferably controlled and monitored by the central controller 750 (FIG. 16).

Figure 19A:
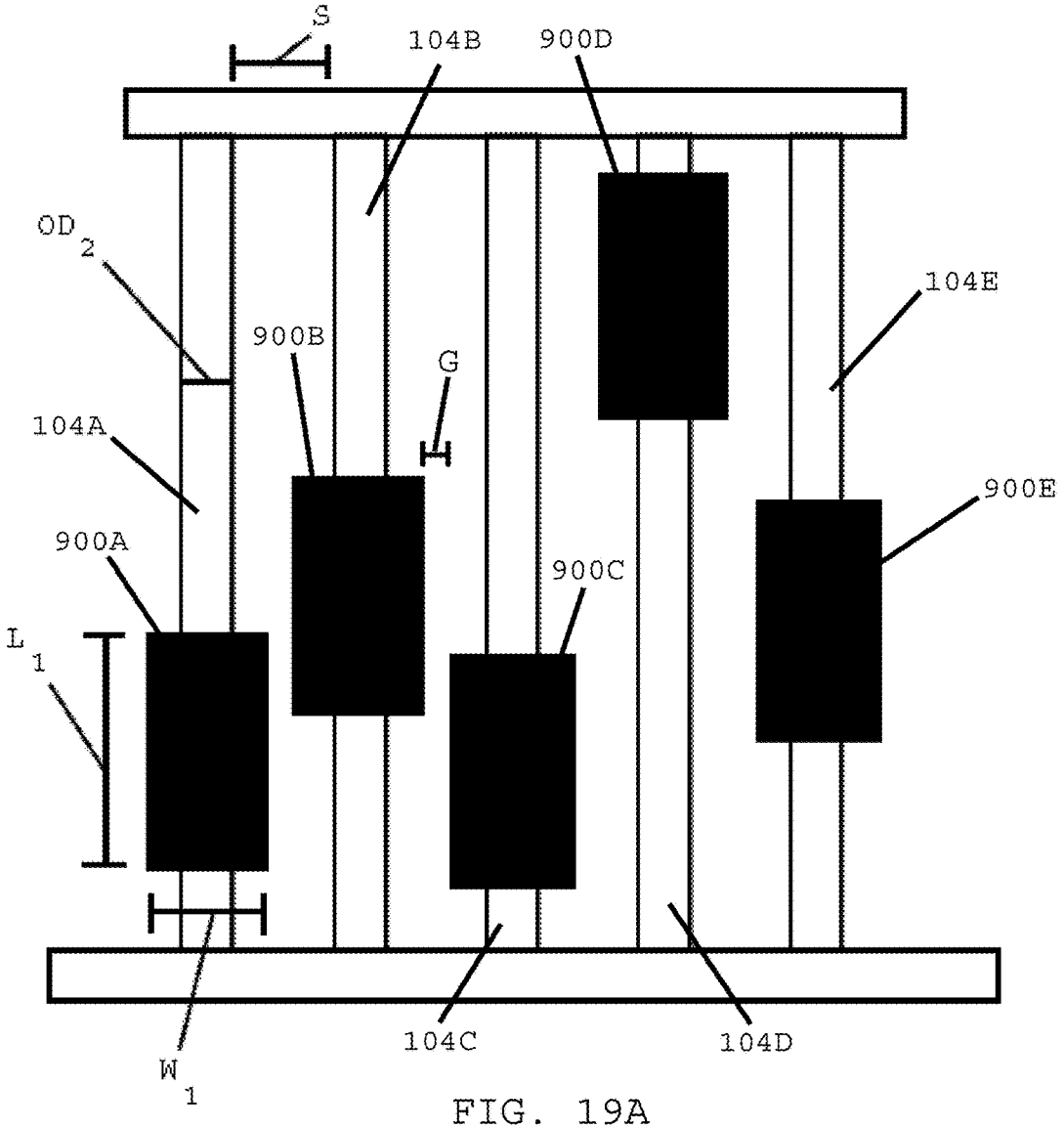
FIG. 19A shows a system for cleaning heat exchange tubes, the system including cleaning robots adapted to move together between upper and lower ends of heat exchange tubes, in accordance with one embodiment of the present patent application.
Figure 19B:
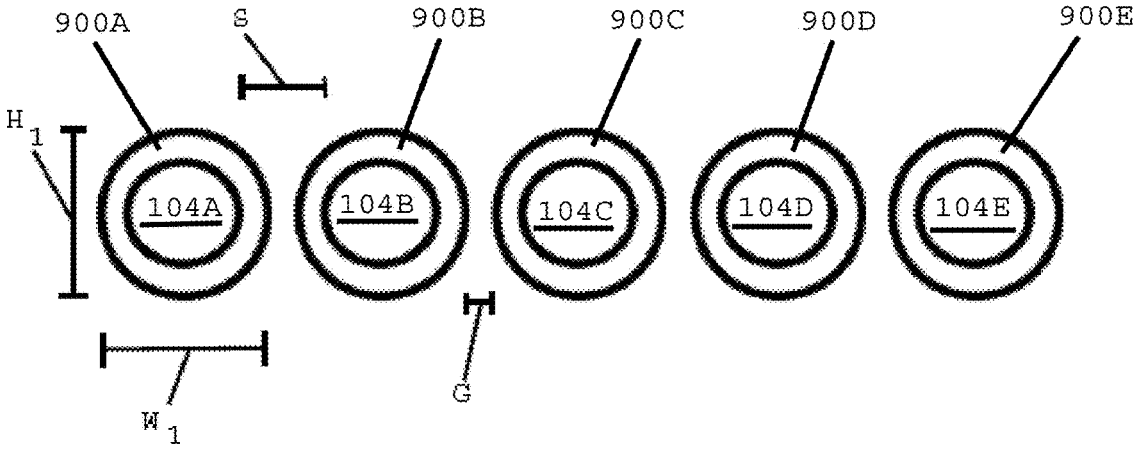
FIG. 19B shows a top cross-sectional view of the system shown in FIG. 19A.

Referring to FIGS. 19A and 19B, in one embodiment, a cleaning system may include cleaning robots 900A-900E that are assembled over outer surfaces of respective heat exchange tubes 104A-104E of a heat exchange system. The heat exchange tubes are preferably spaced from one another so that fluid may pass between the tubes. The heat exchange tubes are preferably spaced from one another and exhaust or flue gas is passed over the tubes for transferring heat to the heat exchange tubes.

In one embodiment, the heat exchange tubes 104A-104E have an outer diameter $OD_2$ of about 0.5-6 inches and more preferably about 1-4 inches. In one embodiment, the heat exchange tubes are spaced from one another by a distance designated S. In one embodiment, the heat exchange tubes have an outer diameter of about one inch and the spacing S between adjacent tubes is about 0.5 inches. In one embodiment, the heat exchange tubes have an outer diameter of about 1.5 inches and the spacing S between adjacent tubes is about 0.75 inches. In one embodiment, the heat exchange tubes have an outer diameter of about two inches and the spacing S between adjacent tubes is about 1.0 inch. In one embodiment, the heat exchange tubes have an outer diameter of about three inches and the spacing S between adjacent tubes is about 1.5 inches. In one embodiment, the heat exchange tubes have an outer diameter of about four inches and the spacing S between adjacent tubes is about 2.0 inches.

In one embodiment, the cleaning robots 900A-900E are adapted to move independently of one another between the upper and lower ends of the respective heat exchange tubes 104A-104E for removing soot and scale from the outer surfaces of the tubes. The cleaning robots 900A-900E have a dimensions that enable the robots to pass by one another as they move between the upper and lower ends of the heat exchange tubes 104A-104E. In one embodiment, a gap G is present between adjacent cleaning robots for enabling the robots to pass one another as they move between the upper and lower ends of the heat exchange tubes 104A-104E.

In one embodiment, the cleaning robots 900A-900E surround the respective heat exchange tubes 104A-104E for removing soot and scale from the outer surfaces of the tubes. In one embodiment, each cleaning robot has a length, a width and a height. In one embodiment, the width of a cleaning robot is preferably greater than the outer diameter of a heat exchange tube. In one embodiment, the height of a cleaning robot is preferably greater than the outer diameter of a heat exchange tube. In one embodiment, a cleaning robot has a length $L_1$ of about 5-20 inches and more preferably about 9-16 inches, a width $W_1$ of about 1.50-6.0 inches, and a height $H_1$ of about 1.50-6.5 inches. The above-described dimensions for a cleaning robot are exemplary in nature only and may be modified so that the cleaning robot covers an outer surfaced of a heat exchange tube and is able to pass by a cleaning robot on an adjacent heat exchange tube.

Figure 20:
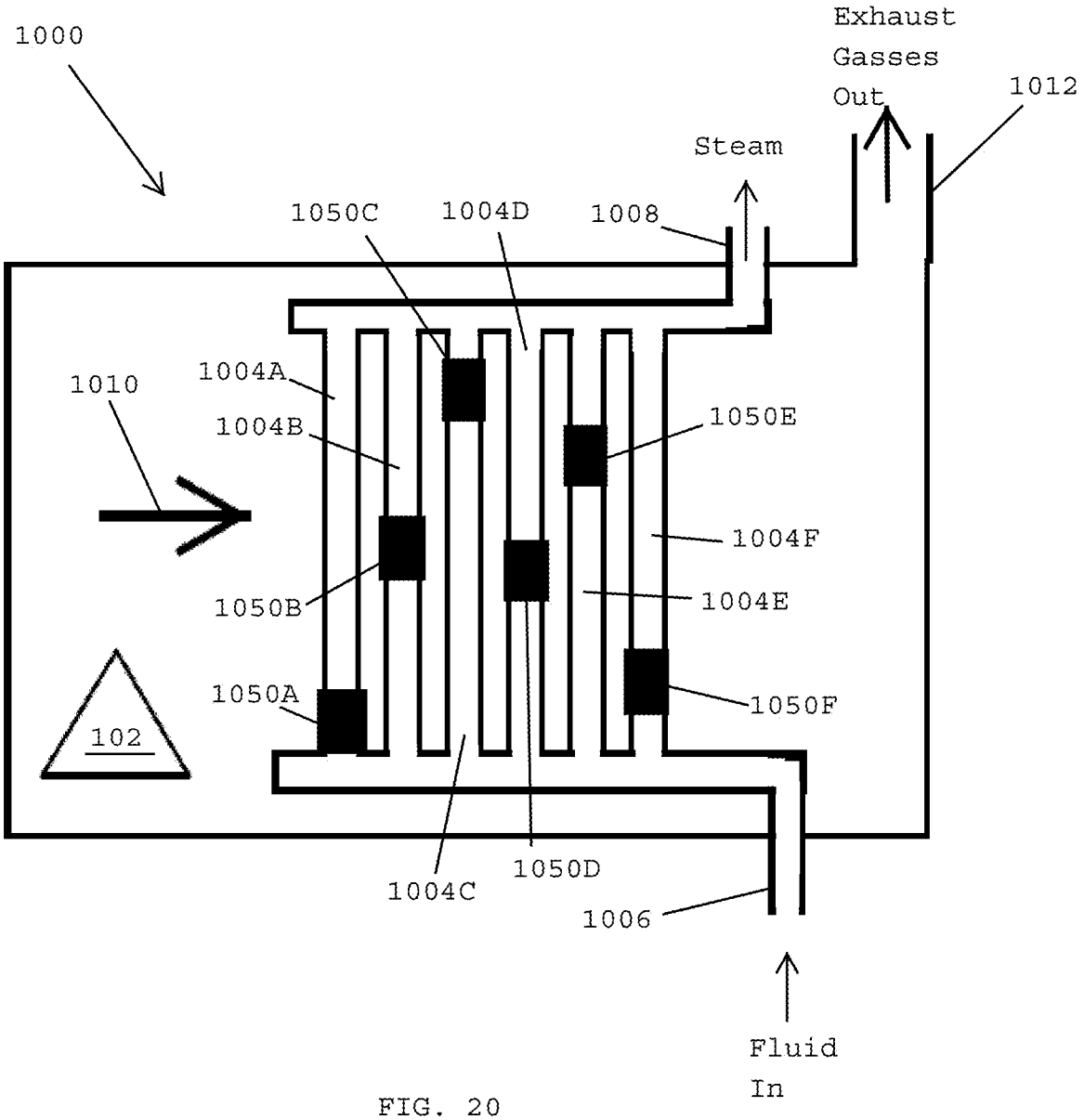
FIG. 20 shows a boiler including a system for cleaning the outer surfaces of heat exchange tubes, in accordance with one embodiment of the present patent application.

Referring to FIG. 20, in one embodiment, a boiler 1000 preferably includes a furnace 1002 that generates heat for heating a fluid (e.g., water) passing through heat exchange tubes 1004A-1004F. The fluid is introduced into the heat exchange tubes 1004A-1004F via an inlet 1006 and is discharged from the heat exchange tubes via a fluid outlet 1008. Hot exhaust gases 1010 that are generated by the furnace 1002 are directed over the outer surfaces of the heat exchange tubes 1004A-1004F for heating the fluid passing through the heat exchange tubes. The heat exchange tubes 1004A-1004F are spaced from one another and the hot exhaust gases 1010 preferably pass over the outer surfaces of the heat exchange tubes 1004A-1004F and between the spaced heat exchange tubes 1004A-1004F. After the hot exhaust gasses 1010 pass by the spaced heat exchange tubes, the hot exhaust gasses 1010 are discharged from the boiler 1000 via a smoke stack 1012.

As the hot exhaust gases pass by the spaced heat exchange tubes 1004A-1004F, the impurities in the exhaust gasses, such as soot and scale, are deposited over the outer surfaces of the heat exchange tubes, which may adversely impact the transfer of heat from the hot exhaust gasses to the fluid running through the heat exchange tubes.

In one embodiment, cleaning robots 1050A-1050F may be assembled over the outer surfaces of the respective heat exchange tubes 1004A-1004E. In one embodiment, the cleaning robots 1050A-1050F are adapted to move independently of one another between the upper and lower ends of the respective heat exchange tubes 1004A-1004F for removing soot and scale from the outer surfaces of the tubes. The cleaning robots 1050A-1050F preferably have dimensions that enable the robots to pass by one another as they move between the upper and lower ends of the heat exchange tubes 1004A-1004F. In one embodiment, a gap G is present between adjacent cleaning robots for enabling the robots to pass one another as they move between the upper and lower ends of the heat exchange tubes 1004A-1004F.

In one embodiment, the cleaning robots 1050A-1050F surround the respective heat exchange tubes 1004A-1004F for removing soot and scale from the outer surfaces of the tubes. In one embodiment, each cleaning robot has a length, a width and a height. In one embodiment, the width of a cleaning robot is preferably greater than the outer diameter of a heat exchange tube. In one embodiment, the height of a cleaning robot is preferably greater than the outer diameter of a heat exchange tube. The cleaning robots 1050A-1050F are preferably in communication with a central controller that monitors and controls the operation of the cleaning robots.

Figure 21:
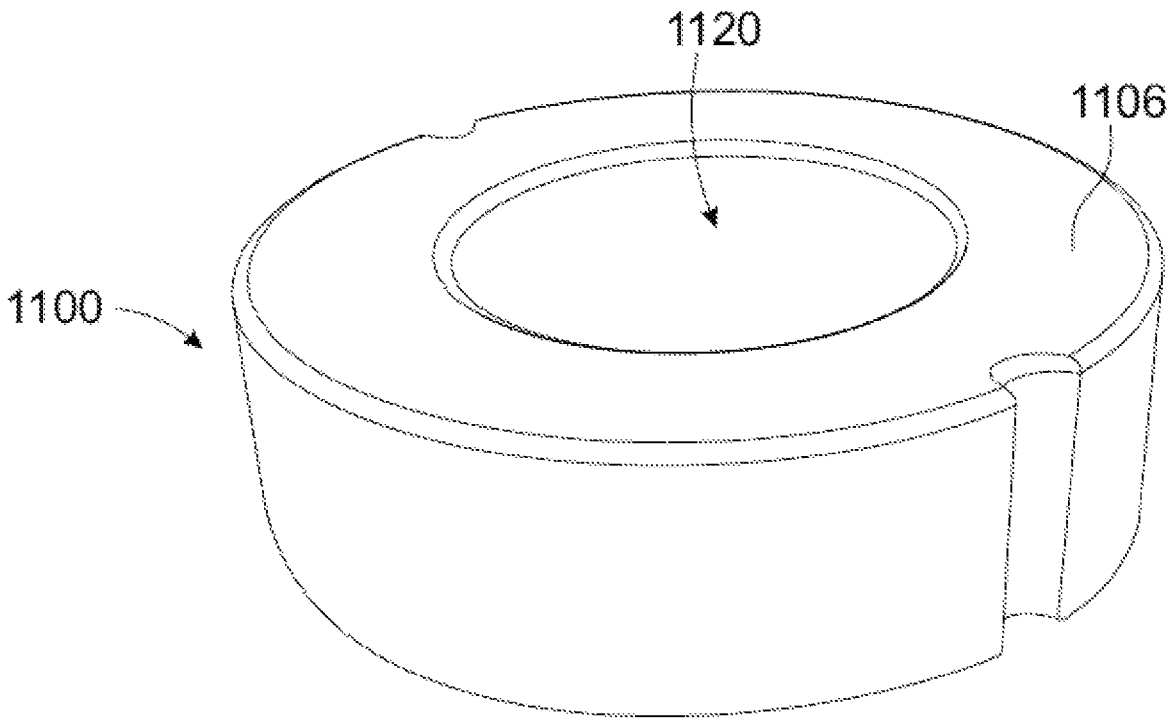
FIG. 21 shows a perspective view of a housing for a cleaning robot, in accordance with one embodiment of the present patent application.

Referring to FIG. 21, in one embodiment, a cleaning robot 1100 preferably includes a housing 1106 that is able to withstand the high temperatures and heat present within furnaces, reactors, and/or boilers so as to protect the components of the cleaning robot (e.g. the battery and the drive assembly). In one embodiment, the housing 1106 has a central opening 1120 that is adapted to be assembled over an outer surface of a heat exchange tube. One or more inwardly extending scraper blades are preferably adapted to project into the central opening 1120 for scraping soot and scale from outer surfaces of respective heat exchange tubes. In one embodiment, the housing 1106 may be made of a ceramic material for protecting the components located inside the housing (e.g., battery, motor, drive-train, wheels, transport assembly, etc.).

In one embodiment, the cleaning robot 1100 may include one or more sensing probes 1125 that are positioned so that each probe is able to touch any object (e.g., soot film, clump of debris) that is located in the path of the cleaning robot as the cleaning robot traverses over a heat exchange tube.

In one embodiment, the sensing probes 1125 preferably function like a cat's whiskers, which are used by a cat to gauge the size of an opening before the cat ventures into the opening. In one embodiment, if the diameter of a soot film or an obstacle located on the outer surface of a heat exchange tube is greater than a pre-determined and/or pre-set diameter for the outer surface of the heat exchange tube, the greater diameter will be sensed by the sensing probes 1125.

Once the sensing probes detect a greater thickness, the cleaning robot system will preferably use the feedback to adjust the size of the opening defined by the scraper blades so that the aperture opening of the scraper blades is large enough to enable the cleaning robot to traverse over the detected obstacle. Once the cleaning robot 1100 passes over the obstacle or thicker soot film section, a trailing sensor 1135 may initiate a closing sequence of the aperture of the scraper blades to the pre-set aperture size.

Figures 22A, 22B, 22C:
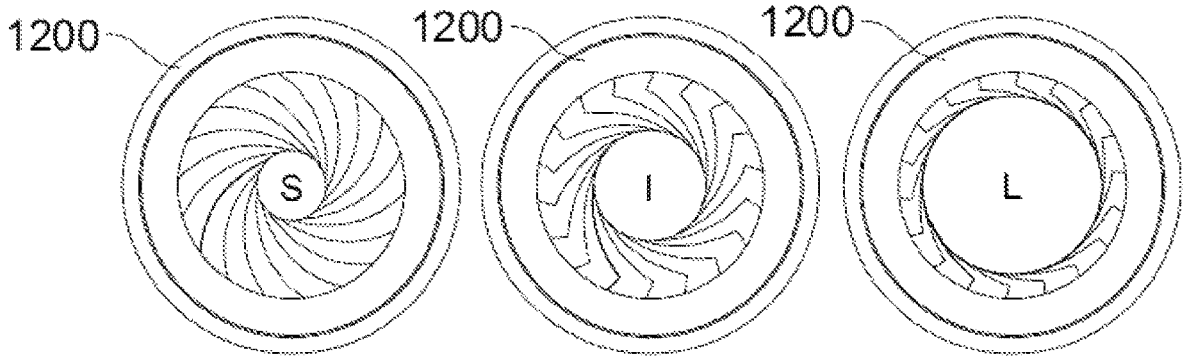
FIG. 22A shows a cleaning robot having scraping blades in a small aperture position, in accordance with one embodiment of the present patent application.
FIG. 22B shows the cleaning robot of FIG. 22A with the scraping blades in an intermediate aperture position.
FIG. 22C shows the cleaning robot of FIGS. 22A and 22B with the scraping blades in a large aperture position.

Referring to FIGS. 22A-22C, in one embodiment, a cleaning robot 1200 has a plurality of scraping blades 1208 that move independently of one another and that are configured into a structure that is similar to the elements of a camera aperture, which allows for very precise variation of the aperture opening and closing.

In one embodiment, the scraping blades 1208 may be made of a tungsten, manganese, carbide alloy, which enables the scraping blades to be temperature resistant and maintain hardness and dimensional conformity at elevated temperatures within the range of 900-1,100 degrees Celsius.

In one embodiment, the blade edges of the scraper blades 1208 may be honed to micron level sharpness and have a specified profile, which enables the scraper blades to remove the soot film or debris that is located on the outer surface of the heat exchange tube at a precise angle to ensure optimum removal of the soot. In one embodiment, the angle may be adjusted for different soot film characteristics In one embodiment, a cleaning robot system may include an actuator mechanism that opens and closes the camera aperture shaped scraping blades 1208 for opening and closing the aperture based upon a feedback system, which may include circuit breakers and pressure transducers.

In one embodiment, the cleaning robot 1200 having camera aperture shaped scraping blades may include at the circumferential periphery thereof a lever that moves in an arc, which translates into a calibrated amount of opening of the aperture.

Figure 23:
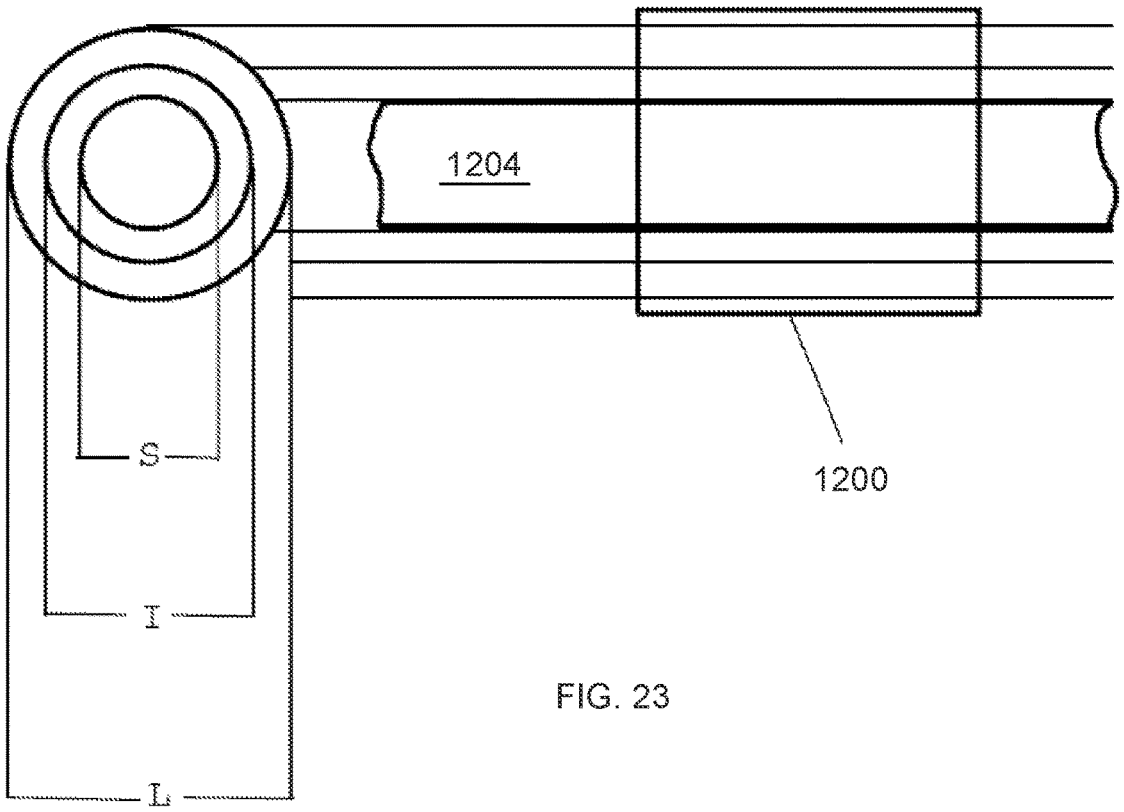
FIG. 23 shows a schematic view of a cleaning robot having scraping blades having a camera aperture configuration, in accordance with one embodiment of the present patent application.

FIG. 22A shows the scraper blades 1208 in a small aperture position S. FIG. 22B shows the scraper blades 1208 in an intermediate aperture position I. FIG. 22C shows the scraper blades 1208 in a larger aperture position L. The small S, intermediate I, and large L aperture sizes defined by the scraper blades 1208 (FIG. 22A) are also shown in FIG. 23. The blades may open and close to adjust the size of the aperture of the cleaning robot 1200 in response to the size of the soot film, debris, and/or obstacles that are detected on the outer surface of the heat exchange tube 1204.

In one embodiment, a cleaning robot with scraper blades having the camera aperture configuration may have a split construction, which desirably enables the cleaning robot to be removed from and re-clasped around a heat exchange tube without requiring the heat exchange tubes to be cut and re-welded.

In one embodiment, a cleaning robot may include a micro gear system that is used to actuate the degree of opening and closing of the camera aperture configured scraper blades.

Figure 24:
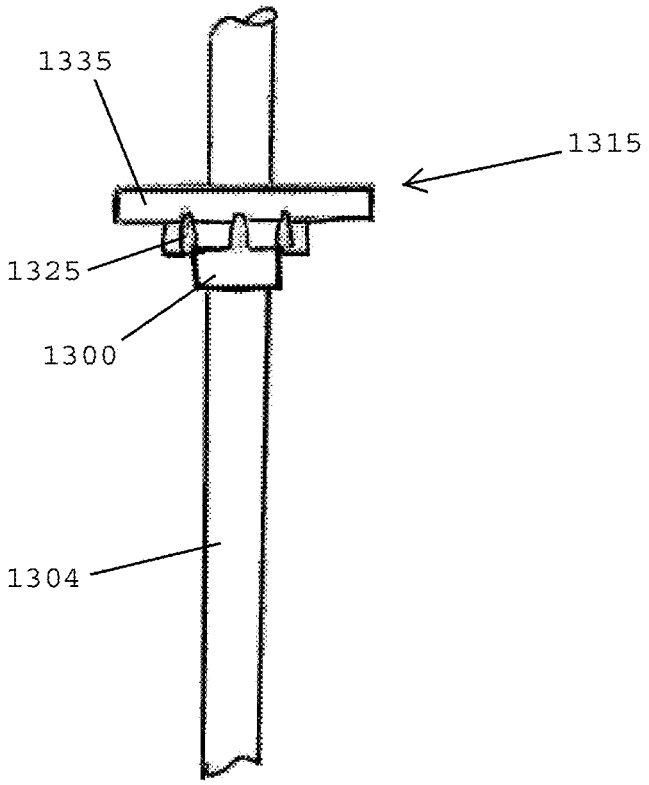
FIG. 24 illustrates a docking station for a cleaning robot, in accordance with one embodiment of the present patent application.
Figure 25:
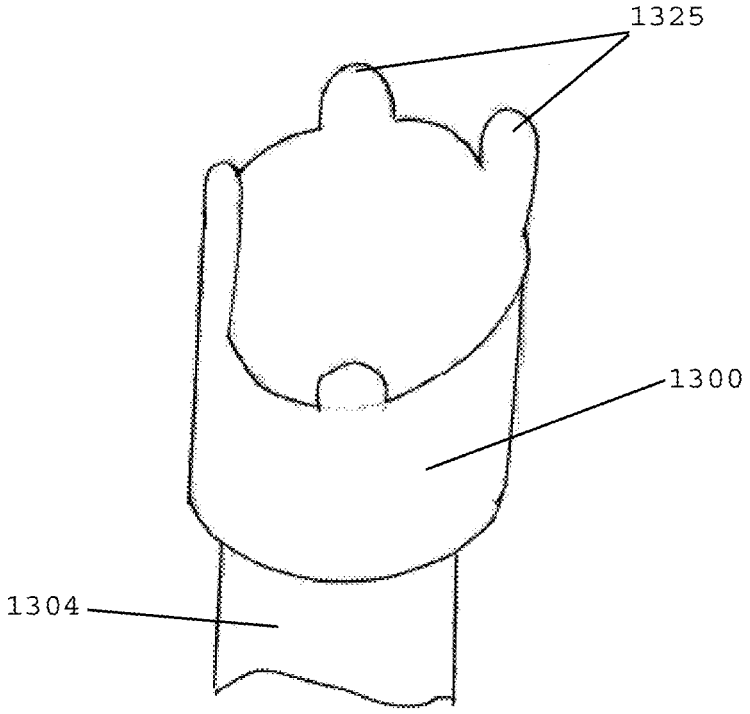
FIG. 25 is a perspective view of the cleaning robot shown in FIG. 24.

Referring to FIGS. 24 and 25, in one embodiment, a cleaning robot system may include a cleaning robot docking station 1315 that enables a cleaning robot 1300 to be stored within a controlled temperature environment (e.g., of not more than 50 degrees Celsius) during a docking period so that the cleaning robot will remain unaffected by the high in-situ temperatures and heat that are present within a boiler or furnace. In one embodiment, the cleaning robot 1300 may have guide flanges 1325 that project from an upper end thereof for meshing with guide notches formed in a docking station plate 1335 that is secured to a heat exchange tube 1304.

Figure 26:
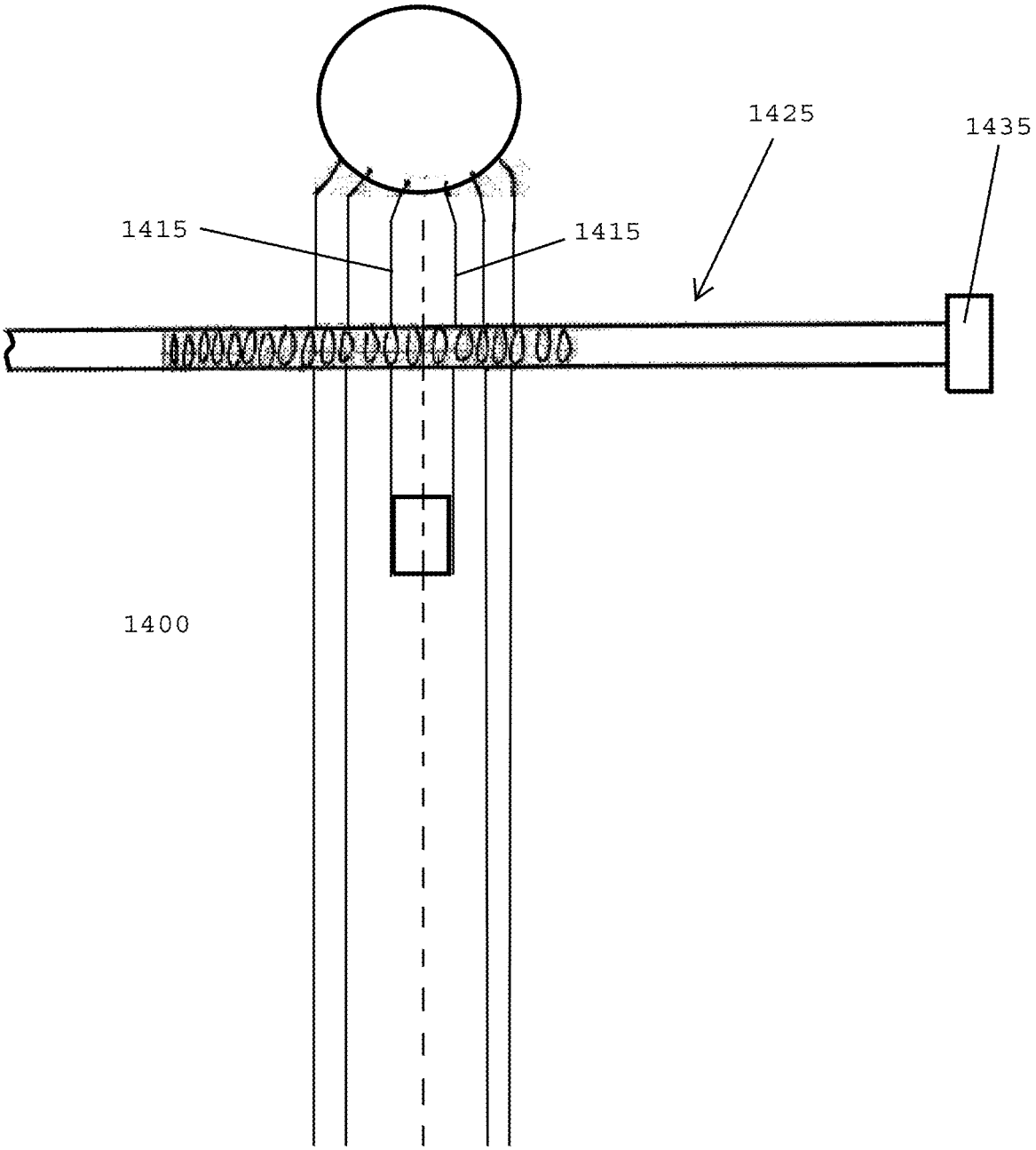
FIG. 26 is a schematic view of a hoist system used to raise and lower a cleaning robot over an outer surface of a heat exchange tube, in accordance with one embodiment of the present patent application.

Referring to FIG. 26, in one embodiment, a cleaning robot 1400 may be moved up and down along an outer surface of a heat exchange tube, such as by using cables 1415 that lower and raise the cleaning robot 1400 relative to the heat exchange tube. The cables 1415 preferably control the rate at which the cleaning robot 1400 is lowered and raised relative to the heat exchange tube.

In one embodiment, the cables 1415 may be connected with a hoist/winch 1425 that is located at an upper docking point, whereby at least two cables are attached to each cleaning robot. In one embodiment, the descent of a cleaning robot 1400 during downward traverse may be due to gravitational forces. In one embodiment, the rate of the descent is preferably controlled by the cables 1415.

In one embodiment, the upper ascent of the cleaning robot may be by a winching action of the hoist 1425, which is located at the uppermost point of the traverse.

In one embodiment, a driving mechanism 1435 for the hoist 1425 is preferably located outside of the main boiler body. In one embodiment, the driving mechanism 1435 preferably draws power from the main supply system of the factory/boiler.

Figure 27:
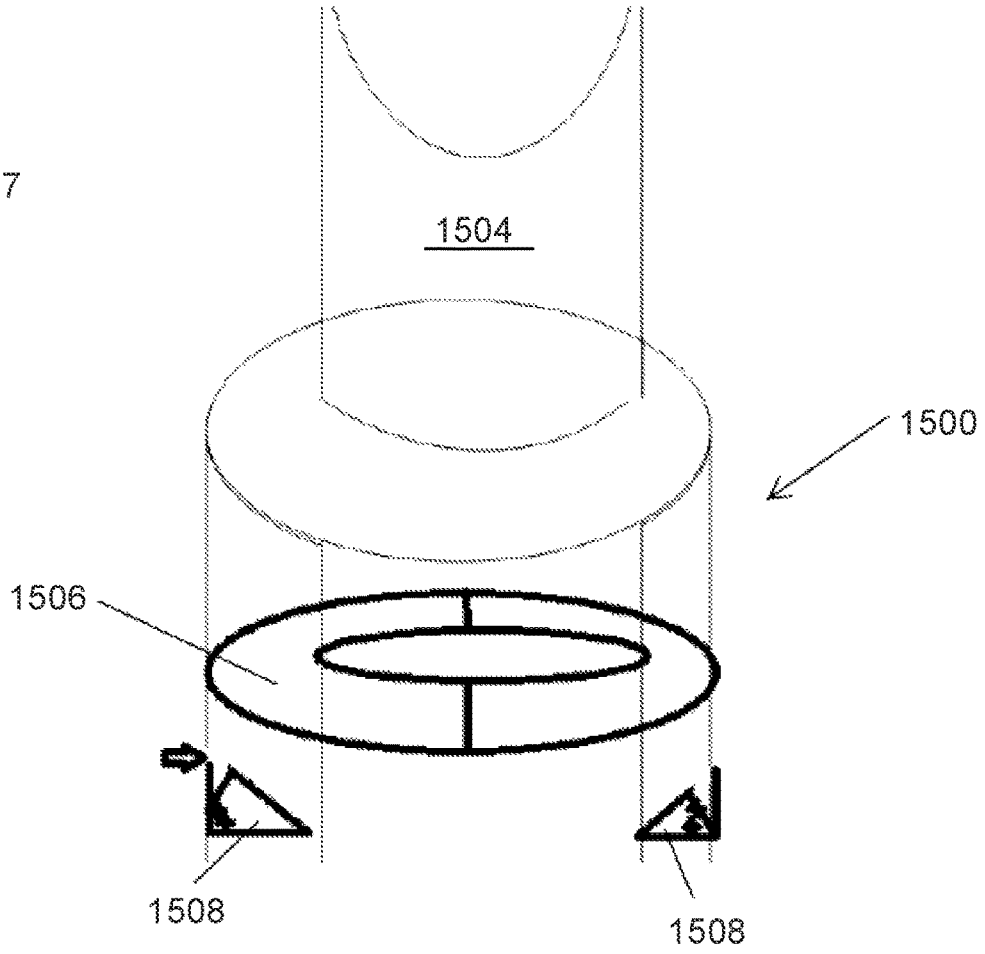
FIG. 27 is a schematic view of a cleaning robot having shark teeth adapted to scrape an outer surface of a heat exchange tube, in accordance with one embodiment of the present patent application.

Referring to FIG. 27, in this embodiment, a cleaning robot 1500 preferably includes a series of shark-like teeth 1508 that are attached to an inner surface of a cylindrical-shaped support 1506. In one embodiment, the shark-like teeth 1508 may incline back to allow an increased margin of passage over any soot film thickness or obstruction located on an outer surface of a heat exchange tube 1504.

In one embodiment, the shark-like teeth 1508 may be provided in consecutive and/or successive rows, one after the other. Each row of shark teeth may be supported on a small lip and/or ledge shaped support, which holds the shark teeth in a pre-set position (e.g., with the cutting edges of the shark teeth in close contact with the soot film on the heat exchange tube.

Figure 28:
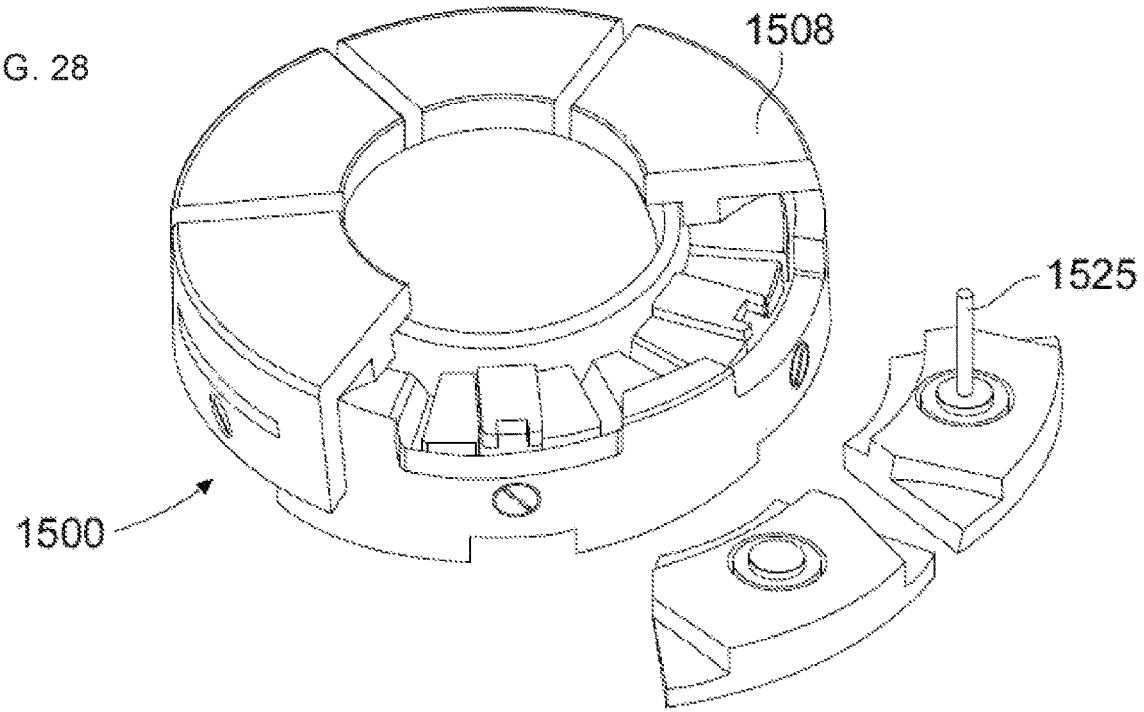
FIG. 28 is a schematic view of a cleaning robot having shark teeth adapted to scrape an outer surface of a heat exchange tube, in accordance with another embodiment of the present patent application.

Referring to FIG. 28, in one embodiment, if there is any larger thickness of material or debris on the outer surface of the heat exchange tube, the shark teeth 1508 will preferably recline back, being hinged on a small pin like round support 1525 with a fulcrum-like arrangement. The reclining back action, permits a gap to open up, increasing the margin for passage of the cleaning robot 1500 by a desired extent.

In one embodiment, a second row of shark teeth that follow a first row of shark teeth are positioned so that their cutting edges will just touch a soot film or obstacle that is one order of thickness more than the first row of shark teeth. Again if the soot material on the tube is thicker than the extent calibrated, the second row of shark teeth will recline around their fulcrum and lean back to allow an even larger margin of passage for the shark teeth of the cleaning robot.

In one embodiment, the number of consecutive rows of shark teeth that are present in a cleaning robot may depend upon the extent to which the shark teeth of a row are able to lean back. In one embodiment, the last row or shark teeth are preferably configured to allow passage over any thickness of debris size that is permanently in place on the heat exchange tube.

Figure 29:
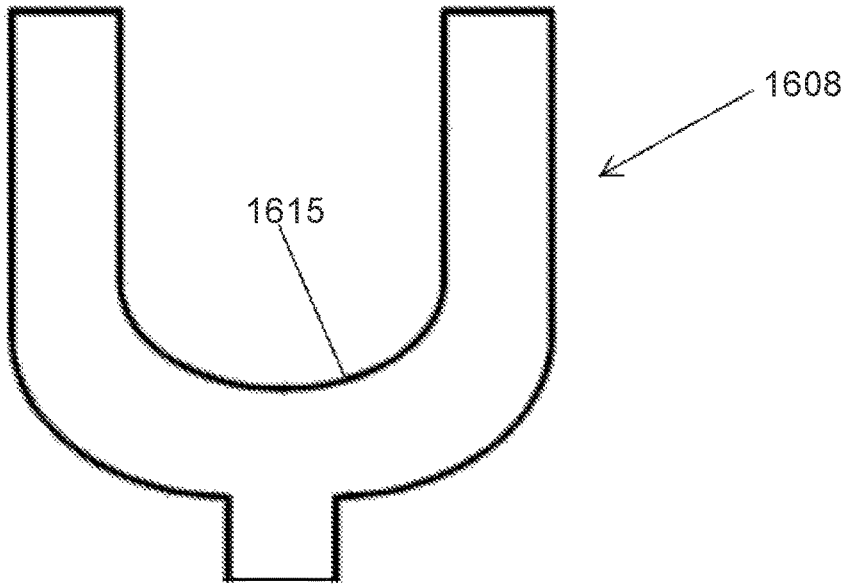
FIG. 29 is a schematic view of a horseshoe-shaped scraper blade for a cleaning robot, in accordance with one embodiment of the present patent application.

Referring to FIG. 29, in one embodiment, a cleaning robot may include one or more horseshoe-shaped scraper blades 1608 that have a semicircular shaped scraping surface 1615. The horseshoe-shaped scraper blade 1608 desirably has an inner diameter that preferably removes a soot film that forms on the outer surface of a heat exchange tube. In one embodiment, the horseshoe-shaped scraper blade may be fitted into a body of a cleaning robot. In one embodiment, the horseshoe-shaped scraper blade may be extended and/or retracted using springs, gears, or a screw type action.

In one embodiment, a cleaning robot may include a series of horseshoe-shaped scraper blades disposed within a body of the cleaning robot, whereby the blades may be individually extended and retracted to accommodate soot films and obstacles having various thicknesses and/or diameters using the control systems and methodologies disclosed herein.

Figure 30:
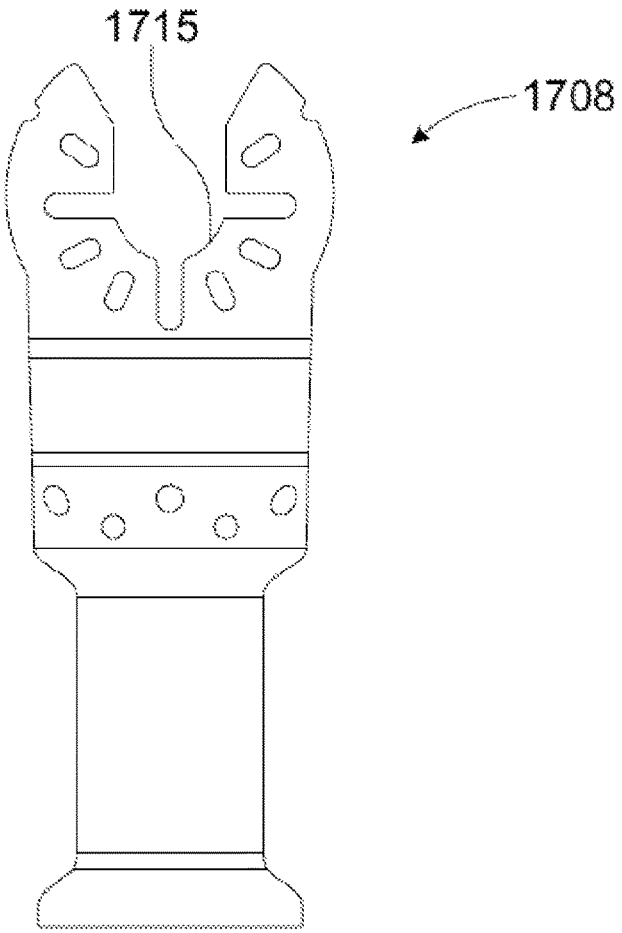
FIG. 30 is a schematic view of a horseshoe-shaped scraper blade for a cleaning robot, in accordance with another embodiment of the present patent application.

FIG. 30 shows another embodiment of a horseshoe-shaped scrapper blade 1708 having a semicircular scraping edge 1715 that may be incorporated into a cleaning robot. In one embodiment, the scraping edge 1715 extends only part of the way around the outer surface of a heat exchange tube and may be located on only one side of a heat exchange tube.

In one embodiment, as a cleaning robot traverses an outer surface of a heat exchange tube, the cleaning robot may be configured so that inner edges of one or more of its scraper blades are immediately adjacent the outer surface of the heat exchange tube so that the soot film (e.g., initially just a few mm thick) that is present on the heat exchange tube is scraped off the tube surface without the one or more scraper blades contacting the outer surface of the heat exchange tube, which would form abrasions in the outer surface of the heat exchange tube.

In one embodiment, as the cleaning robot traverses along the length of a heating tube it may encounter variations of thicknesses of the soot film, clumps of carried over particulate material and/or but weld joints defining a diameter that is greater than the outer diameter of the heat exchange tube. Thus, in one embodiment, the cleaning robot is preferably adapted to adjust the scraper aperture size accordingly. Moreover, the cleaning robot is preferably configured to return the size of the scraper aperture back to its pre-set diameter once the obstacle that is present on the outer surface of the heat exchange tube is cleared.

In one embodiment, the scraper blades are initially pre-set to a desired setting (e.g., aperture size) to scrape soot having a standard film thickness from the outer surface of the heat exchange tube.

In one embodiment, a cleaning robot system may include a global positioning satellite (GPS) microprocessor that continuously provides a real-time indication regarding the position of the cleaning robot as well as recording the locations of obstacles, such as butt welds and clumps of debris material. The GPS tracking and recording serves to not only automatically open and close the aperture opening while the cleaning robot traverses up and down the heat exchange tube, but also creates a valuable data base of locations where clumps of material accumulate and the frequency of such accumulation occurring. Recording and tracking data regarding the presence of obstacles and soot may be very useful for operational and maintenance purposes as well as provide excellent empirical data that enables engineers to improve the design of the parts.

In one embodiment, the cleaning robot may clean the outer surface of a heat exchange tube on either a downward traverse, an upward traverse, or on both the downward and upward traverses.

In one embodiment, a cleaning robot may use one or more real-time feedback devices that optically scan the outer surface of the heat exchange tube. In one embodiment, an optical scanning system may include built-in optical lenses made of materials (e.g., mica) that are suited for and able to withstand the temperatures and conditions present within boilers and furnaces.

In one embodiment, one or more optical lenses preferably relay images of the outer surfaces of the heat exchange tubes via optical cables to consoles and/or control systems located outside the boilers and furnaces.

In one embodiment, a system may use an encoder to mark and/or record the distance of traverse of a cleaning robot and use the distance data to open and close the aperture of the scraper blades.

In one embodiment, a system may include magnets that are powered via a cable so that the aperture of the scraper blades will open and close in the event of failure of power and/or shut off of power.

In one embodiment, a cleaning robot may include rotary type scrapper blades that operate in a manner that is similar to rotary head shavers for removing soot and debris from the outer surfaces of heat exchange tubes.

In one embodiment, data generated by a cleaning robot during its downward and upward traverses, such as the location of soot build up, bumps, and/or defects on an outer surface of the heat exchange tube are preferably stored in a computer database that is located outside the boiler. A system controller that actuates the opening and closing of the scraping aperture of a cleaning robot, and that controls the up and down movement of the cleaning robot over the heat exchange tube desirably uses the database to optimize the operations of the cleaning robot.

In one embodiment, a cleaning robot preferably includes one or more global positioning satellite (GPS) components that enable the exact location of the cleaning robot to be determined at all times.

In one embodiment, a cleaning robot may encircle only a portion of a heat exchange tube and may not fully encircle a heat exchange tube.

In one embodiment, a cleaning robot may include a dynamo system having a magnetic coil and the rotating element which rotates it is due to the downward movement of the cleaning robot and the roller bearings. In one embodiment, the rotation of the coil within the magnetic field creates a charge which can be discharged as required to actuate the aperture opening mechanism of the iris aperture scrapper.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A system for cleaning a surface of a heat exchanging boiler tube comprising:

a boiler tube having a first end, a second end, and an outer surface that extends between the first and second ends;

a cleaning robot configured to travel over the outer surface of said boiler tube for cleaning the outer surface of said boiler tube, said cleaning robot comprising a housing having an opening extending therethrough, a cleaning tool mounted on said housing and extending into the opening of said housing, a wheel coupled with said housing, a motor coupled with said wheel for driving rotation of said wheel to move said housing over the outer surface of said boiler tube;

a system controller including one or more microprocessors and one or more software programs for monitoring and controlling operation of said cleaning robot, wherein said system controller is in wireless communication with said cleaning robot, and wherein said cleaning robot comprises a GPS device for recording location and velocity information for said cleaning robot; and a wireless transmitter for wirelessly transmitting the location and velocity information to said system controller.

2. The system as claimed in claim 1, wherein the opening in said housing has a cylindrical shape, and wherein said cleaning tool comprises at least one scraper that extends into the cylindrical-shaped opening.

3. The system as claimed in claim 2, wherein said at least one scraper comprises at least one ring-shaped scraper having an inner scraping edge that projects into the cylindrical-shaped opening of said housing and that opposes the outer surface of said boiler tube.

4. The system as claimed in claim 3, wherein said at least one ring-shaped scraper comprises a plurality of ring-shaped scrapers having respective inner scraping edges that extend into the cylindrical-shaped opening of said housing.

5. The system as claimed in claim 3, wherein said boiler tube passes through the cylindrical-shaped opening of said housing.

6. The system as claimed in claim 5, wherein the inner scraping edge of said at least one ring-shaped scraper opposes the outer surface of said boiler tube for removing deposits from the outer surface of said boiler tube.

7. The system as claimed in claim 1, wherein said housing comprises a ceramic material.

8. The system as claimed in claim 1, wherein said motor comprises an electric motor coupled with said wheel, and wherein said system further comprises a battery that produces electricity for said electric motor.

9. The system as claimed in claim 8, further comprising a charging station for re-charging said battery.

10. A system for cleaning heat exchanging boiler tubes comprising:

a boiler having two or more boiler tubes that are spaced from one another for allowing heated exhaust gas to pass between said boiler tubes, wherein each said boiler tube has an outer surface;

a plurality of cleaning robots assembled with said two or more spaced boiler tubes, wherein each one of said cleaning robot is assembled with a different one of said boiler tubes;

wherein each said cleaning robot comprises a housing having an opening extending therethrough for receiving one of said boiler tubes, a scraper blade extending into the opening of said housing, said scraper blade having an inner scraping edge that opposes the outer surface of the one of said boiler tubes, a wheel coupled with said housing for rolling over the outer surface of the one of said boiler tubes, a motor coupled with said wheel for driving rotation of said wheel to move said cleaning robot over the outer surface of the one of said boiler tubes;

a system controller including one or more microprocessors and one or more software programs for monitoring and controlling operation of each of said cleaning robots, wherein said system controller is in wireless communication with each of said cleaning robots, and wherein said cleaning robots move independently of one another.

11. The system as claimed in claim 10, wherein the opening in said housing has a cylindrical shape, and wherein said scraper blade comprises a ring-shaped scraper blade that projects into said cylindrical-shaped opening of said housing.

12. The system as claimed in claim 11, wherein the outer surface of said boiler tube defines an outer diameter, and wherein the inner scraping edge of said ring-shaped scraper blade defines an inner diameter that is greater than the outer diameter of the outer surface of said boiler tube.

13. The system as claimed in claim 10, wherein each said boiler tube has a first end, a second end, and a length that extends between the first and second ends, and wherein said one or more software programs comprise:

code for controlling the location of each said cleaning robot along the lengths of said respective boiler tubes;

code for controlling the direction of movement of each said cleaning robot along the lengths of said respective boiler tubes;

code for controlling the velocity of each said cleaning robot along the lengths of said respective boiler tubes.

14. The system as claimed in claim 13, wherein said one or more software programs further comprise code for activating said motors for moving said cleaning robots back and forth between the first and second ends of said respective boiler tubes, wherein said scraper blade is configured to remove deposits from the outer surface of said boiler tube.

15. A system for cleaning a boiler comprising:

a first boiler tube having an outer surface;

a second boiler tube having an outer surface, wherein said first and second boiler tubes are spaced from one another;

a first cleaning robot assembled with said first boiler tube and being configured to travel over the outer surface of said first boiler tube to clean deposits from the outer surface of said first boiler tube;

a second cleaning robot assembled with said second boiler tube and being configured to travel over the outer surface of said second boiler tube to clean deposits from the outer surface of said second boiler tube;

a system controller including one or more microprocessors and one or more software programs for monitoring and controlling operation of each of said first and second cleaning robots, wherein said system controller is in wireless communication with said first and second cleaning robots, and wherein said system further comprises code for moving said first and second cleaning robots independently of one another between first and second ends of said respective boiler tubes.

16. The system as claimed in claim 15, wherein each said cleaning robot comprises:

a housing having an opening extending therethrough for receiving one of said heat exchange tubes;

a scraper blade extending into the opening of said housing, said scraper blade having an inner scraping edge that opposes the outer surface of the one of said boiler tubes;

a wheel coupled with said housing and being configured to roll over the outer surface of the one of said boiler tubes;

an electric motor coupled with said wheel for driving rotation of said wheel to move said cleaning robot over the outer surface of the one of said boiler tubes; and a battery coupled with said electric motor for providing electricity to said electric motor.

17. The system as claimed in claim 16, wherein said scraper blade comprises a plurality of said scraper blades that are spaced from one another and that have respective inner scraping edges that oppose the outer surface of the one of said boiler tubes.

18. A system for cleaning a surface of a heat exchanging boiler tube comprising:

a boiler tube having a first end, a second end, and an outer surface that extends between the first and second ends;

a cleaning robot configured to travel over the outer surface of said boiler tube for cleaning the outer surface of said boiler tube, said cleaning robot comprising a housing having an opening extending therethrough, a cleaning tool mounted on said housing and extending into the opening of said housing, a wheel coupled with said housing, a motor coupled with said wheel for driving rotation of said wheel to move said housing over the outer surface of said boiler tube:

a system controller including one or more microprocessors and one or more software programs for monitoring and controlling operation of said cleaning robot;

wherein said motor comprises an electric motor coupled with said wheel, and wherein said system further comprises a battery that produces electricity for said electric motor and a charging station for re-charging said battery.

* * * * *